US008927188B2

(12) United States Patent
Naka et al.

(10) Patent No.: US 8,927,188 B2
(45) Date of Patent: Jan. 6, 2015

(54) METHOD OF PRODUCING MAGNETIC CARRIER AND MAGNETIC CARRIER THAT USES THIS PRODUCTION METHOD

(71) Applicant: Canon Kabushiki Kaisha, Tokyo (JP)

(72) Inventors: Takeshi Naka, Suntou-gun (JP); Masayuki Hama, Toride (JP); Kentaro Kamae, Kashiwa (JP); Koh Ishigami, Abiko (JP); Yoshinobu Baba, Yokohama (JP); Hiroaki Kawakami, Yokohama (JP); Yojiro Hotta, Mishima (JP); Satoshi Mita, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/952,252

(22) Filed: Jul. 26, 2013

(65) Prior Publication Data

US 2014/0038098 A1 Feb. 6, 2014

(30) Foreign Application Priority Data

Aug. 1, 2012 (JP) ..... 2012-171423

(51) Int. Cl.
*G03G 9/113* (2006.01)
*G03G 9/107* (2006.01)

(52) U.S. Cl.
CPC ..... *G03G 9/1131* (2013.01); *G03G 9/1075* (2013.01)
USPC ..... 430/137.13; 430/111.35

(58) Field of Classification Search
USPC ..... 430/137.13, 111.35
See application file for complete search history.

(56) References Cited

U.S. PATENT DOCUMENTS

| | | | |
|---|---|---|---|
| 5,340,677 | A | 8/1994 | Baba et al. |
| 5,439,771 | A | 8/1995 | Baba et al. |
| 5,464,720 | A | 11/1995 | Baba et al. |
| 5,494,770 | A | 2/1996 | Baba et al. |
| 5,576,133 | A | 11/1996 | Baba et al. |
| 5,712,069 | A | 1/1998 | Baba et al. |
| 5,766,814 | A | 6/1998 | Baba et al. |
| 6,010,811 | A | 1/2000 | Baba et al. |
| 6,083,655 | A | 7/2000 | Itabashi et al. |
| 6,159,648 | A | 12/2000 | Baba et al. |
| 6,165,663 | A | 12/2000 | Baba et al. |
| 6,430,384 | B2 | 8/2002 | Hama et al. |
| 7,144,668 | B2 | 12/2006 | Baba et al. |

(Continued)

FOREIGN PATENT DOCUMENTS

| | | | |
|---|---|---|---|
| JP | 63-235959 | A | 9/1988 |
| JP | 2-256074 | A | 10/1990 |

(Continued)

*Primary Examiner* — Peter Vajda
(74) *Attorney, Agent, or Firm* — Fitzpatrick, Cella, Harper and Scinto

(57) ABSTRACT

A method of producing a magnetic carrier, having a coating process step in which a surface of a magnetic carrier core is coated with particles of a resin composition by a mechanical impact force. The coating process step has a first coating process step of mixing, dispersing, and fixing the particles on the surface of the core, and a second coating process step, which is performed after the first coating process step, of carrying out a film-forming coating process on the particles. In the first and second coating process steps, the peripheral velocity of the outermost end of stirring members, the coating process time, the product temperature at the end of the coating process, and the glass-transition temperature of the resin component satisfy specific relationships.

2 Claims, 7 Drawing Sheets

(56) References Cited

U.S. PATENT DOCUMENTS

| | | | | |
|---|---|---|---|---|
| 7,244,539 | B2 | 7/2007 | Baba et al. | |
| 7,279,262 | B2 | 10/2007 | Fujikawa et al. | |
| 7,767,370 | B2 | 8/2010 | Ishigami et al. | |
| 7,858,283 | B2 | 12/2010 | Ishigami et al. | |
| 7,906,262 | B2 | 3/2011 | Ishigami et al. | |
| 7,927,775 | B2 | 4/2011 | Komatsu et al. | |
| 7,939,233 | B2 | 5/2011 | Inoue et al. | |
| 8,114,562 | B2 | 2/2012 | Ishigami et al. | |
| 8,137,886 | B2 | 3/2012 | Baba et al. | |
| 8,142,972 | B2 | 3/2012 | Hotta et al. | |
| 8,323,726 | B2 | 12/2012 | Naka et al. | |
| 2010/0183971 | A1 | 7/2010 | Fujikawa et al. | |
| 2010/0248126 | A1 | 9/2010 | Ishigami et al. | |
| 2010/0273103 | A1 | 10/2010 | Baba et al. | |
| 2010/0279224 | A1* | 11/2010 | Okamoto et al. | 430/111.1 |
| 2010/0310978 | A1 | 12/2010 | Endo et al. | |
| 2011/0097661 | A1 | 4/2011 | Ishigami et al. | |
| 2012/0214097 | A1 | 8/2012 | Naka et al. | |
| 2013/0196265 | A1 | 8/2013 | Kamae et al. | |
| 2013/0244159 | A1 | 9/2013 | Ishigami et al. | |
| 2013/0316282 | A1 | 11/2013 | Ishigami et al. | |
| 2014/0030650 | A1 | 1/2014 | Komatsu et al. | |
| 2014/0045115 | A1 | 2/2014 | Baba et al. | |
| 2014/0051023 | A1 | 2/2014 | Hotta et al. | |

FOREIGN PATENT DOCUMENTS

| | | | |
|---|---|---|---|
| JP | 2010-128393 | A | 6/2010 |
| JP | 2011-2686 | A | 1/2011 |
| JP | 2011-75855 | A | 4/2011 |
| JP | 2012-8368 | A | 1/2012 |

* cited by examiner

METHOD OF PRODUCING MAGNETIC CARRIER AND MAGNETIC CARRIER THAT USES THIS PRODUCTION METHOD

BACKGROUND OF THE INVENTION

1. Field of the Invention

The present invention relates to a method of producing a magnetic carrier that is used in developing methods in which a toner image is formed on an electrostatic latent image bearing member by the development using a two-component developer of an electrostatic latent image formed on the electrostatic latent image bearing member. The present invention further relates to a magnetic carrier produced using this production method.

2. Description of the Related Art

In order to satisfy market needs such as the accelerated color shift in office use, the more intense colorfulness levels sought by the graphics market, and faster speeds for light-duty printing, an even higher image quality, higher stability, and higher durability have in recent years been required from a performance standpoint of the two-component developers used in electrophotographic printing methods.

At the present time, the magnetic carrier present in two-component developers mainly takes the form of a magnetic carrier in which a coat layer is formed by a resin composition on the surface of a ferrite core or a resin core having a magnetic body dispersed therein (these cores are collectively referred to below as magnetic carrier cores).

This resin composition coat layer functions to inhibit charge injection from the magnetic carrier into the photosensitive member, in order thereby to stabilize the charge distribution on the toner and improve the durability in terms of enabling stable charging even during extended use.

Accordingly, it is very important that the resin composition coat layer be uniformly coated on the magnetic carrier core surface.

In the present invention, a uniform coating treatment refers to a state in which the coat layer of the resin composition coats the whole magnetic carrier core surface and in which, in addition to the smoothness of the magnetic carrier surface, the resin density within the coat layer is uniform. This uniform resin density within the coat layer is a state in which openings in the coat layer are not present or, if they are present, they are uniformly dispersed.

Wet coating treatment methods, infra, have frequently been used to execute a uniform coating treatment of the magnetic carrier core surface with the resin composition.

This wet coating treatment refers to methods in which the surface of magnetic carrier core suspended in a fluid bed is spray coated with a coating solution in which the resin composition is dissolved in a solvent, and to methods in which the coating treatment is carried out by immersing the magnetic carrier core in a coating solution in which the resin composition is dissolved in a solvent.

These wet coating treatment methods, because the coating treatment is carried out in a solution, offer the advantage of carrying out a coating treatment by the resin composition on the magnetic carrier core surface that is uniform within the coat layer.

However, a problem with wet coating treatments has been the facile agglomeration of the magnetic carrier when the solvent is evaporated off.

However, when a magnetic carrier that has undergone agglomeration is deagglomerated by stirring, the surface of the magnetic carrier core may be exposed to some degree at the parting surfaces, and as a result the coat layer on the magnetic carrier surface becomes nonuniform and a leakage event, which is the previously mentioned charge leakage event from the magnetic carrier to the photosensitive member, can readily occur.

When such a leakage event occurs, the surface potential of the photosensitive member converges to the developing bias and the development contrast cannot be securely maintained and a blank dot image may be produced.

In addition, this exposure of the magnetic carrier core surface can also prevent the toner charge from being maintained, particularly at high temperatures and high humidities, and a low toner charge after long-term standing can also readily result in, for example, image defects such as fogging.

Moreover, a special drying step is required in order to completely remove the solvent, which causes the takt time to increase, and thus much also remains to be improved from a production standpoint with wet coating treatments. In addition, when the resin composition particles have a weight-average molecular weight Mw of at least 100,000 for the tetrahydrofuran (THF)-soluble matter in the resin component present in the resin composition, dissolution in a solvent is then difficult to achieve and there may be limitations on the selection of the resin composition.

Dry coating treatments, which carry out the coating treatment thermally without using a solvent and using particles of the resin composition, have therefore been introduced as methods that overcome the aforementioned problems associated with wet coating treatments.

For example, the following method is disclosed in Japanese Patent Application Laid-open No. 2011-075855.

First, 2.0 mass parts of resin composition particles (glass-transition temperature (Tg)=98° C./number-average primary particle diameter=0.1 μm) and 100.0 mass parts of a magnetic carrier core are mixed.

Then, coating with the resin is carried out by stirring for 20 minutes using a high-speed stirring and mixing device at a temperature of 90° C. and at 13 m/sec for the rotational velocity in the horizontal direction; the internal temperature is adjusted to 120° C.; and the magnetic carrier is obtained by subsequently carrying out a heat treatment for 30 minutes while stirring at 5 m/sec.

In this method, the entire apparatus is heated by the flow of a thermal medium in a jacket disposed on the inside of the main casing and the temperature of the processed material as a whole is brought to at least the glass-transition temperature (Tg) of the resin composition particles present in the processed material.

However, since in this method the temperature of the entire apparatus is brought to at least the glass-transition temperature (Tg) of the resin composition particles, agglomeration of the magnetic carrier is facilitated, and thus much remains to be improved in terms of carrying out a uniform coating process.

In addition, the magnetic carrier core is mixed with the resin composition particles using a separate apparatus from the apparatus used for the coating process, and the requirement for a separate mixing apparatus is inconvenient.

The following method is disclosed in Japanese Patent Application Laid-open No. 2010-128393.

A mixture is first obtained by mixing a magnetic carrier core and resin composition particles at a magnetic carrier core:resin composition particle weight ratio=97:3.

This mixture is then introduced into a Spartan Ryuzer (Dalton Co., Ltd.) and is stirred (total of 90 minutes at a peripheral velocity of 18.5 m/second). The apparatus temperature is raised as stirring progresses, and, after the temperature has reached 80° C., stirring is carried out for 60 minutes while maintaining the temperature.

This is followed by introduction into a circulating hot air current-type oven (SPHH, ESPEC Corp.) and heating over 1 hour at 200° C. to obtain the magnetic carrier by curing the resin coat layer on the magnetic carrier core surface.

However, residual resin composition particles may be produced when the resin composition particles are to be coated in large amounts on the magnetic carrier core, and thus much remains to be improved in terms of carrying out a uniform coating process.

In addition, the resin composition particles on the magnetic carrier core surface are cured in this method using a separate apparatus from the apparatus used for the coating process, and the requirement for a separate apparatus for curing is inconvenient.

In contrast to these methods that carry out the dry coating process based on heat, methods have been introduced that carry out the dry coating process based on mechanical impact force.

For example, a method is disclosed in Japanese Patent Application Laid-open No. S63 (1988)-235959 in which the magnetic carrier core surface is coated by resin composition particles having a particle diameter of not more than one-tenth that of the magnetic carrier core using a surface modification process apparatus that has a rotor and a stator.

Using resin composition particles that have a particle diameter of not more than one-tenth that of the magnetic carrier core, this method creates a single-layer coat layer of the resin composition particles on the magnetic carrier core surface and carries out coating with this by mechanical impact force.

However, when resin composition particles having a particle diameter that is more than one-tenth that of the magnetic carrier core are used in this method, these resin composition particles must be dispersed using an apparatus separate from the apparatus used for coating the magnetic carrier core surface.

When a dispersing apparatus is not used, resin composition particles then remain free and the favorable execution of coating of the resin composition particles on the magnetic carrier core surface is impaired.

In addition, even when the resin composition particles are attached to the magnetic carrier core surface using an apparatus different from the coating apparatus, excess resin composition particles end up being present in a free state when the resin composition particles are added in an amount too large for attachment and the execution of a uniform coating is then problematic.

Below, excess resin composition particles are referred to as residual resin composition particles.

Accordingly, there are limitations in this method on the amount of coating by the resin composition particles, and this may ultimately impair the ability to control the amount of toner charge and inhibit charge injection from the magnetic carrier to the photosensitive member.

In contrast to the preceding, in order to raise the amount of coating by the resin composition particles, a method has been disclosed in Japanese Patent No. 2811079 that uses a high-speed stirrer/mixer and that intermittently feeds the resin composition particles divided into at least two additions.

However, with this method also, residual resin composition particles that do not participate in coating are produced and the coverage ratio changes with each production of the magnetic carrier and magnetic carrier-to-magnetic carrier property variations are produced; as a consequence, it may not be possible to obtain a consistent magnetic carrier on an extended basis.

A processing apparatus is provided in Japanese Patent Application Laid-open No. 2011-2686 as another composite-forming processing apparatus that uses a mechanical impact force.

This processing apparatus, while exploiting the advantages of a rotating blade-type apparatus, can achieve an excellent coating of the magnetic carrier by raising the stirring effect by applying, to the processed material of the magnetic carrier core and resin composition particles, a force with a heretofore unavailable strength.

Furthermore, by carrying out coating with the resin composition particles a plurality of times, a substantial mitigation with regard to the smoothness of the surface and the residual resin composition particles can be achieved.

However, while the uniformity of the magnetic carrier surface is improved, variation is still present in terms of bringing about a uniform resin density within the coating resin layer and some nonuniformity is produced in how the coat layer is shaved off during durability testing: variation in the amount of toner charge then appears in the latter half of durability testing and fogging is produced in some cases. As a consequence, substantial improvement is still required.

A method of producing a highly durable two-component developer is provided in Japanese Patent Application Laid-open No. 2012-8368.

In this method, a porous ferrite and resin particles are mixed at a temperature below the glass-transition temperature of the resin particles to produce a carrier intermediate in which the resin particles are attached to the surface and in the pores of the porous ferrite. Film formation is then performed on the carrier intermediate at a temperature greater than or equal to the glass-transition temperature of the resin particles. As a result, a low specific gravity magnetic carrier with a uniform surface is obtained without requiring resin in the interior of the magnetic carrier and a highly durable two-component developer is thereby obtained.

However, the production of the carrier intermediate involves just the attachment of the resin particles in the neighborhood of the surface of the porous ferrite core, and film formation simply by stirring at a temperature greater than or equal to the glass-transition temperature when the resin coat layer is formed can result in the presence in a more or less scattered manner of gaps within the resin coat layer and thus in the appearance of scatter in the local resistance. As a result, depending on the resistance of the porous ferrite core, it may not be possible to inhibit charge injection from the magnetic carrier into the photosensitive member and a blank dot image may be produced. In addition, some bias may occur in how the coat layer is shaved off during durability testing and scatter in the amount of toner charge may be produced and fogging may be generated.

Thus, as has been described in the preceding, much remains to be improved in order—in the coating of resin composition particles on the surface of magnetic carrier core by a dry coating process—to uniformly coat the magnetic carrier core surface and achieve uniform coating even in the interior of the coat layer.

SUMMARY OF THE INVENTION

The present invention is therefore directed to providing a production method that can uniformly carry out a coating process on the magnetic carrier core surface and within the coat layer when the magnetic carrier core surface is coated by resin composition particles by a dry coating process.

The present invention is additionally directed to providing a magnetic carrier that exhibits an excellent timewise stability whereby a decline in the amount of charge on the toner after standing is suppressed even in the presence of high temperatures and high humidities.

According to one aspect of the present invention, there is provided a method of producing a magnetic carrier, a surface of which is coated with a resin composition, the method comprising a coating process step in which a surface of a magnetic carrier core is coated with particles of the resin composition by a mechanical impact force, wherein:

the coating process step has;

a first coating process step of mixing, dispersing, and fixing the resin composition particles on the surface of the magnetic carrier core; and a second coating process step, which is performed after the first coating process step, of carrying out a film-forming coating process in which the particles of the resin composition fixed on the magnetic carrier core are spread on the surface of the magnetic carrier core, wherein:

the first coating process step and the second coating process step are carried out by using an apparatus provided with a rotating member having a plurality of stirring members on the surface thereof, a drive member that rotates the rotating member, and a main casing disposed so as to have a gap between an inner circumferential surface of the main casing and the stirring members, in the first coating process step and the second coating process step, the magnetic carrier core and the resin composition particles are transported by a part of the stirring members in a direction of the drive member that is one direction along an axial direction of the rotating member while being transported into the gap by a centrifugal force generated accompanying the rotation of the rotating member and are transported by another part of the stirring members in a counterdirection to the drive member that is an opposite direction to the one direction along the axial direction of the rotating member, and the coating of the surface of the magnetic carrier core with the resin composition particles is performed while repeating the transport in the direction of the drive member and the transport in the counterdirection to the drive member, when KT (second) represents a coating process time in the first coating process step, KF (° C.) represents a product temperature at the finish of the coating process, and Tg represents a glass-transition temperature of the resin component present in the resin composition, the peripheral velocity of the outermost end of the stirring members during the coating process time in the first coating process step is at least 3 m/sec and not more than 7 m/sec, KT is at least 60 seconds and not more than 1800 seconds, KF satisfies $KF \leq Tg-40°$ C., and the peripheral velocity of the outermost end of the stirring members in the second coating process step is at least 8 m/sec and not more than 20 m/sec, and when HF (° C.) represents a product temperature at the finish of the film-forming coating process in the second coating process step, and Tg represents a glass-transition temperature of the resin component present in the resin composition, HF satisfies $Tg-20° C. \leq HF \leq Tg+20° C.$ According to another aspect of the present invention, there is provided a magnetic carrier produced by the above-described production method according to the present invention, the surface of which has been coated with the resin composition.

Further features of the present invention will become apparent from the following description of exemplary embodiments (with reference to the attached drawings).

DESCRIPTION OF THE EMBODIMENTS

The present invention are described in detail in the following.

The present invention is a method of producing a magnetic carrier in which the surface of a magnetic carrier core is coated with a resin composition, wherein this method has a coating process step of coating particles of the resin composition on the surface of the magnetic carrier core by a mechanical impact force.

In addition, this coating process step has a first coating process step of mixing, dispersing, and fixing the resin composition particles on the surface of the magnetic carrier core and has a second coating process step, which is performed after the first coating process step, of carrying out a film-forming coating process of the resin composition particles in which the resin composition particles fixed on the surface of the magnetic carrier core are spread on the surface of the magnetic carrier core. This first coating process step and second coating process step are carried out by using an apparatus that has a rotating member having a plurality of stirring members on the surface thereof, a drive member that rotates the rotating member, and a main casing disposed to have a gap with the stirring members.

First, an embodiment of the coating processing apparatus used by the first and second coating process steps of the present invention will be described using FIGS. 1 and 2.

Figure 1:
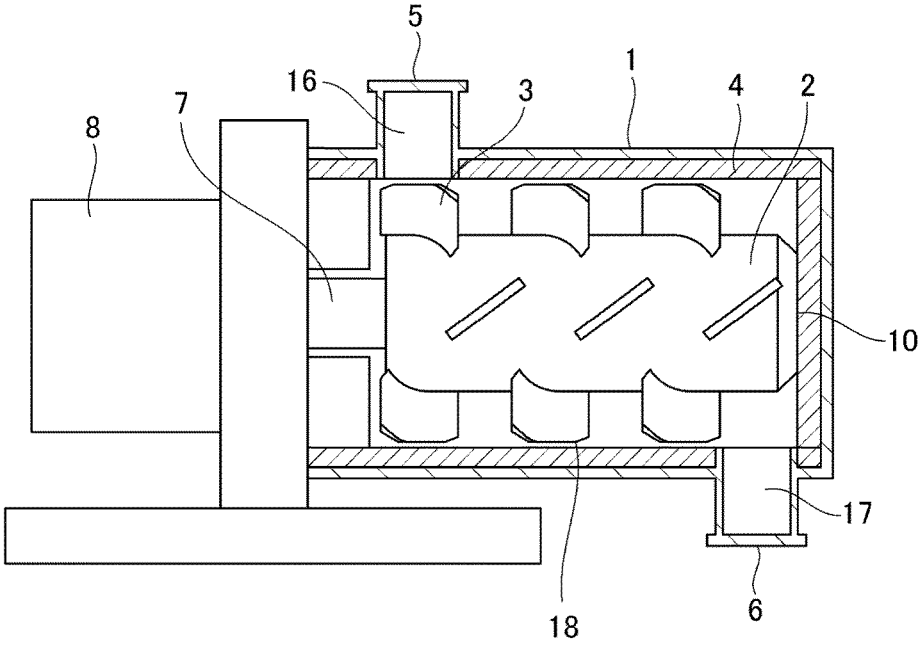
FIG. 1 is a schematic diagram that shows an example of a coating processing apparatus that can be used in the magnetic carrier production method of the present invention.

As shown in FIG. 1, the coating processing apparatus used by the present invention has a rotating member 2 having on the surface thereof at least a plurality of a stirring member 3, a drive member 8 that rotates the rotating member 2, and a main casing 1 disposed to have a minimum gap 18 with the stirring members 3.

Using the coating processing apparatus shown in FIG. 1, the present invention carries out the coating of a resin composition on the surface of magnetic carrier core by stirring and mixing resin composition particles and a magnetic carrier core that have been introduced into the coating processing apparatus.

This magnetic carrier core and the resin composition particles are referred to below as the processed material.

Figure 2:
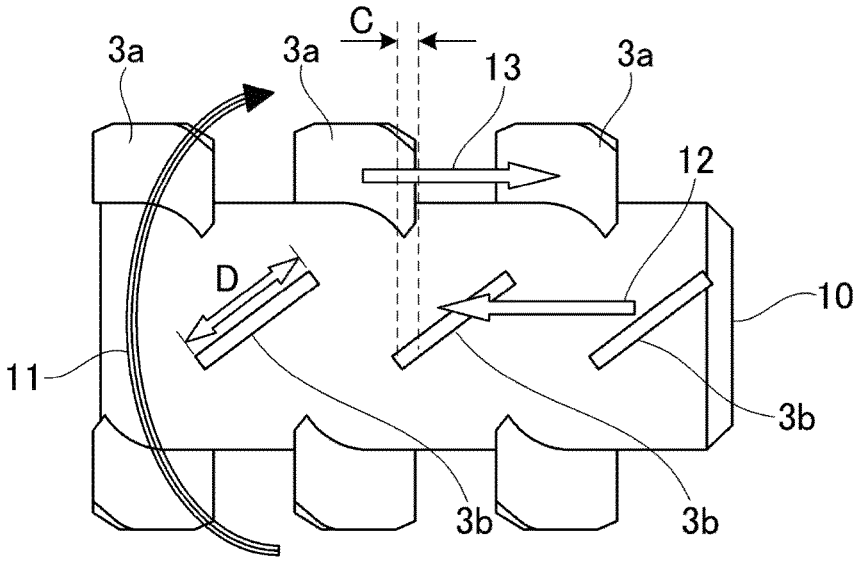
FIG. 2 is a schematic diagram that shows the structure of one example of the stirring members used in a coating processing apparatus that can be used in the magnetic carrier production method of the present invention.

The processed material that has been introduced into the coating processing apparatus is transported into the minimum gap 18 by the centrifugal force generated in association with rotational motion 11, shown in FIG. 2, of the rotating member 2.

The processed material transported into the minimum gap 18 is transported by a part of the stirring members 3 in the direction 12 of the drive member that is one direction along the axial direction of the rotating member 2. In addition, it is transported by another part of the stirring members 3 in the counterdirection 13 to the drive member that is the opposite direction to the one direction along the axial direction of the rotating member.

The coating of the magnetic carrier core surface with the resin composition is performed while repeating the transport 12 in the direction of the drive member and the transport 13 in the counterdirection to the drive member, which are a series of movements.

An embodiment of the coating processing apparatus used in the first and second coating process steps of the present invention is explained in additional detail below with reference to the schematic diagrams in FIGS. 1 and 2 of a coating processing apparatus.

The coating processing apparatus shown in FIG. 1 has a jacket 4 that can accommodate a thermal medium flow and that resides on the inner side of the main casing 1 and at the side surface 10 at the end of the rotating member, and has a starting material inlet port 5, formed at the top of the main casing 1, for introducing the processed material.

In addition, a magnetic carrier discharge port 6 is formed at the bottom of the main casing 1 in order to discharge the coated magnetic carrier from the main casing 1.

A starting material inlet port inner piece 16 is inserted within the starting material inlet port 5, while a magnetic carrier discharge port inner piece 17 is inserted in the magnetic carrier discharge port 6.

In the present invention, the starting material inlet port inner piece 16 is first removed from the starting material inlet port 5 to open the port and the processed material is introduced through the starting material inlet port 5. Once the processed material has been completely introduced, the starting material inlet port inner piece 16 is inserted to close the port.

The rotating member 2 is then rotated by the drive member 8 and, through the effect of the plurality of stirring members 3 disposed on the surface of the rotating member 2, the first coating process step is carried out while mixing, dispersing, and fixing the resin composition particles on the magnetic carrier core surface, and, after the end of the first coating process step, the second coating process step of carrying out a film-forming coating process on the resin composition particles is then performed.

After the end of the second coating process step, the rotating member 2 is rotated at low speed; the product temperature of the processed material is brought to 50° C. or below; a container or bag for recovering the magnetic carrier is placed under the magnetic carrier discharge port 6; and the magnetic carrier discharge port inner piece 17 is removed.

Then, the rotating member 2 is rotated and the magnetic carrier is discharged through the magnetic carrier discharge port 6. The obtained magnetic carrier is subjected to magnetic separation using a magnetic separator and the residual resin composition particles and foreign material are separated on sieve to provide the magnetic carrier.

When KT (sec) represents the coating process time for the first coating process step, KF (° C.) represents the product temperature at the finish of the coating process, and Tg represents the glass-transition temperature of the resin component present in the resin composition, characteristic features of the present invention are that the peripheral velocity of the outermost end of the stirring members during the coating process time in the first coating process step is at least 3 m/sec and not more than 7 m/sec, the coating process time KT is at least 60 seconds and not more than 1800 seconds, and the product temperature KF satisfies $KF \leq Tg-40°$ C.

Additional characteristic features of the present invention are that the peripheral velocity of the outermost end of the stirring members in the second coating process step is at least 8 m/sec and not more than 20 m/sec and, when HF (° C.) represents the product temperature at the finish of the film-forming coating process in the second coating process step, and Tg represents the glass-transition temperature of the resin component present in the resin composition, the product temperature HF satisfies $Tg-20° C. \leq HF \leq Tg+20°$ C.

According to the results of investigations by the present inventor, when coating is carried out using the apparatus shown in FIG. 1, coating is also possible by a method, as heretofore, in which the processed material introduced into this coating processing apparatus is immediately stirred and mixed.

However, it was found that, when coating is carried out using the apparatus shown in FIG. 1, the first coating process step—which is a mixing, dispersing, and fixing process immediately after the introduction of the processed material—is intimately related to the uniformity within the resin composition layer of the finished magnetic carrier surface.

It was also found that the second coating process step, which is a film-forming coating process carried out after the first coating process step, is intimately related to the surface smoothness and uniformity of the resin composition of the finished magnetic carrier surface.

Characteristic features of the present invention will be described below with reference to the schematic diagrams in FIG. 5.

Figure 5A:
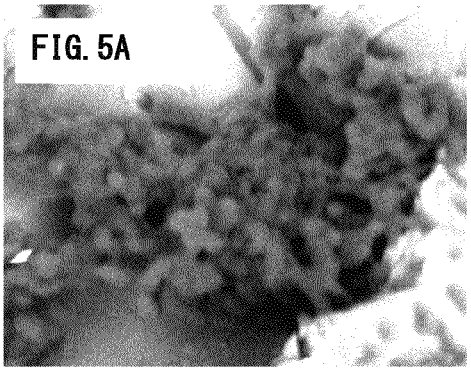
FIG. 5A is a portion of an electron micrograph that shows a nonuniform state obtained in the first coating process step of the magnetic carrier production method of the present invention, in which the resin composition particles are mixed, dispersed, and fixed on a magnetic carrier core surface.
Figure 5B:
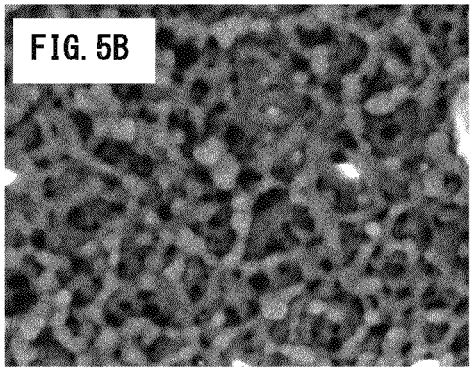
FIG. 5B is a portion of an electron micrograph that shows a state obtained in the first coating process step of the magnetic carrier production method of the present invention, in which the resin composition particles are uniformly mixed, dispersed, and fixed on a magnetic carrier core surface.

According to the results of investigations by the present inventor, it was found that—by establishing certain operating conditions in the first coating process step, which functions to mix, disperse, and fix the resin composition particles—a resin composition intermediate is obtained that exhibits a state in which the resin composition particles are regularly arrayed on the magnetic carrier core surface and the particles are fixed to each other to some degree, as shown in FIG. 5B.

It was further found that in the first coating process step the elaboration over the entire magnetic carrier core surface of the regularly arrayed state of the resin composition particles on the magnetic carrier core surface, as shown in FIG. 5B, is crucial for the uniformity within the resin composition layer.

It was also found to be crucial that the film-forming coating process be executed after the regularly arrayed state of the resin composition particles on the magnetic carrier core surface has been elaborated as an aggregate over the entire magnetic carrier core surface.

This state in which the resin composition particles are regularly arrayed and fixed is referred to below as an ordered mixture.

While the reason for the appearance of an ordered mixture when the first coating process step is controlled to certain operating conditions is uncertain, the present inventor holds as follows.

It is believed that an ideal stirring and mixing and an ideal temperature are both required in order to bring about the appearance of an ordered mixture and that an ordered mixture cannot appear when either is absent. Thus, providing both an ideal stirring and mixing and an ideal temperature is crucial.

The present inventor discovered that both an ideal stirring and mixing and an ideal temperature can be applied to the resin composition particles by controlling the coating processing apparatus used by the present invention to certain operating conditions.

As previously indicated, the coating processing apparatus used by the present invention carries out the coating of the resin composition on the magnetic carrier core surface while repeatedly subjecting the processed material transported into the minimum gap 18 to transport 12 in the direction of the drive member (forward direction) and transport 13 in the counterdirection to the drive member (back direction).

The processed material transported into the minimum gap 18 assumes a state of consolidation into the minimum gap 18 due to the transport 12 in the direction of the drive member, the transport 13 in the counterdirection to the drive member, and the centrifugal force generated accompanying the rotational motion 11 of the rotating member 2.

Thus, the coating processing apparatus used by the present invention carries out a coating process while stirring and mixing in a state in which the processed material is consolidated into the minimum gap 18.

It is also thought that the resin composition particle surface, while being melted by the heat generated when the processed material is stirred and mixed in a state in which the processed material is consolidated into the minimum gap 18, is fixed to the magnetic carrier core surface and that coating proceeds by the development of this.

The present inventor discovered that the above-described process when the magnetic carrier core surface is coated by the resin composition particles in the coating processing apparatus used by the present invention is well suited for the generation of an ordered mixture.

Moreover, as a result of investigations by the present inventor, it was found that the generation of an ordered mixture over the entire surface of the individual magnetic carrier core using conventional coating processing apparatuses is quite problematic.

While the reason for this is uncertain, it is thought that a conventional coating apparatus carries out coating through stirring and mixing brought about by the rotational action and through melting based on control of the temperature within the apparatus, and that as a result, considered in terms of apparatus structure, it is difficult to apply the above-described consolidation action to the processed material.

For example, using the coating processing apparatus shown in FIG. 1, an ordered mixture can be realized by controlling the coating conditions in this apparatus, and particularly the first coating process conditions, to certain operating conditions.

In the case of a conventional coating method using the coating processing apparatus shown in FIG. 1, in which the processed material is subjected to high-speed stirring and mixing immediately after its introduction, variations can be produced in the state of coating by the resin composition particles. The present inventor holds that the cause of this is that the coating process is carried out before the ordered mixture, which appears at the start of stirring, has developed over the entire magnetic carrier particle.

Accordingly, it is crucial that the ordered mixture be caused to occur, before anything else, over the entire individual magnetic carrier particle using operating conditions at which the coating process does not occur.

As a result of investigations by the present inventor, at least 3 m/sec and not more than 7 m/sec, and more preferably at least 4 m/sec and not more than 6 m/sec, was found for the peripheral velocity of the outermost end of the stirring member during the coating process time in the first coating process step.

When the peripheral velocity of the outermost end of the stirring member is less than 3 m/sec, the rotation of the rotating member 2 provides a weak centrifugal force and as a consequence an adequate impact/mixing among the resin composition particles does not occur and, as shown in FIG. 5A, the ordered mixture does not develop over the entire individual magnetic carrier core particle.

Figure 5C:
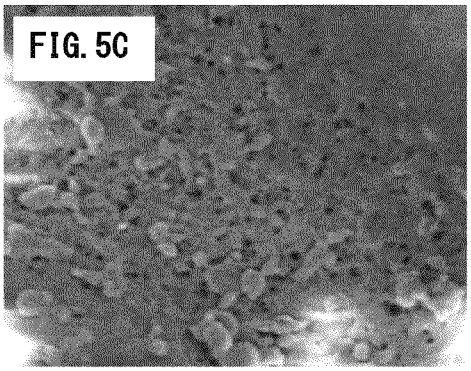
FIG. 5C is a portion of an electron micrograph that shows a nonuniform state obtained in the first coating process step of the magnetic carrier production method of the present invention, in which the resin composition particles are mixed, dispersed, and fixed on a magnetic carrier core surface.

Conversely, when 7 m/sec is exceeded, the rotation of the rotating member 2 provides a strong centrifugal force and as a consequence high-intensity stirring occurs and the heat produced during the coating process becomes too large and the coating process ends up occurring, as shown in FIG. 5C, before the ordered mixture has developed over the entire individual magnetic carrier core particle.

Moreover, the coating process time KT (sec) in the first coating process step is at least 60 seconds and not more than 1800 seconds and is preferably at least 60 seconds and not more than 900 seconds. When the coating process time KT in the first coating process step is less than 60 seconds, the mixing/stirring process itself is too short even when the rotating member 2 is rotated at the appropriate peripheral velocity, and as a consequence the ordered mixture cannot develop over the entire individual magnetic carrier core particle, as shown in FIG. 5A.

Conversely, when the coating process time KT in the first coating process step exceeds 1800 seconds, high-intensity stirring occurs and the heat produced during the coating process becomes too large and the coating process ends up occurring, as shown in FIG. 5C, before the ordered mixture has developed over the entire individual magnetic carrier core particle.

The product temperature KF (° C.) at the finish of the coating process satisfies KF≤Tg−40° C. Preferably KF≤Tg−46° C. is satisfied. (This Tg is the glass-transition temperature of the resin component present in the resin composition).

When the product temperature KF at the finish of the coating process exceeds Tg−40° C., the temperature of the processed material is too high even for operation at the appropriate peripheral velocity for the appropriate processing time, and the coating process then ends up occurring before the ordered mixture has developed over the entire individual magnetic carrier core particle.

The product temperature is measured in the present invention by inserting a 1.6 mmΦ sheathed thermocouple (Chino Corporation) from the bottom to near the inner wall at about the longitudinal center of the main casing 1.

Figure 5D:
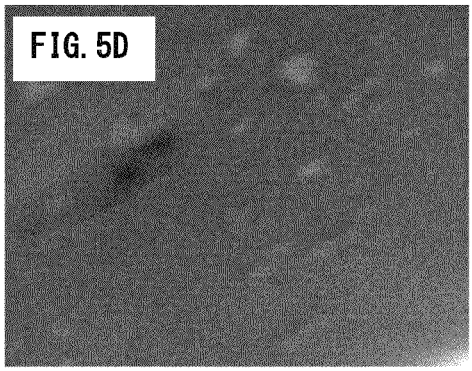
FIG. 5D is a portion of an electron micrograph of a uniform magnetic carrier surface as obtained in the second coating process step of the magnetic carrier production method of the present invention (all are photographs in lieu of drawings)

In the present invention, the second coating process step is carried out after the end of the first coating process step, and a magnetic carrier in which the resin composition has undergone a uniform film-forming coating process, as shown in FIG. 5D, can be obtained by controlling this second coating process step to certain conditions.

The peripheral velocity of the outermost end of the stirring member in the second coating process step is at least 8 m/sec and not more than 20 m/sec and is preferably at least 9 m/sec and not more than 15 m/sec.

When the peripheral velocity of the outermost end of the stirring member in the second coating process step is less than 8 m/sec, the rotation of the rotating member 2 provides a weak centrifugal force and as a consequence an adequate impact/mixing between/among the resin composition particles and magnetic carrier core does not occur and a uniformly coated magnetic carrier cannot then be obtained. Conversely, when the peripheral velocity of the outermost end of the stirring member in the second coating process step exceeds 20 m/sec, the rotation of the rotating member 2 provides a strong centrifugal force and as a consequence high-intensity stirring occurs and the heat produced during the coating process becomes too large and magnetic carrier-to-magnetic carrier melt adhesion may occur within the coating processing apparatus.

In addition, when HF (° C.) represents the product temperature at the end of the film-forming coating process in the second coating process step, and Tg represents the glass-transition temperature of the resin component present in the resin composition, this product temperature HF (° C.) satisfies Tg−20° C.≤HF≤Tg+20° C. Tg−15° C.≤HF≤Tg+19° C. is preferably satisfied.

When the product temperature HF at the end of the film-forming coating process in the second coating process step is less than Tg−20° C., heat generation during the coating process is then insufficient and a uniformly coated magnetic carrier cannot be obtained. The amount of residual resin composition particles is increased as a result.

Conversely, when the product temperature HF at the end of the film-forming coating process in the second coating process step exceeds Tg+20° C., the heat produced during the coating process becomes too large and magnetic carrier-to-magnetic carrier melt adhesion occurs within the coating processing apparatus.

In order in the present invention to control the product temperature KF at the finish of the coating process in the first coating process step and to control the product temperature HF at the finish of the film-forming coating process in the second coating process step, for example, a rotating member 2 may be used that can accommodate the flow of a thermal medium and/or a main casing 1 may be used in which a jacket 4 is disposed. A fluid such as, for example, cooled chiller water, hot water, steam, or an oil, may be used as the thermal medium.

On the other hand, the film-forming coating process time HT (sec) in the second coating process step is preferably at least 300 seconds and not more than 6000 seconds and is more preferably at least 480 seconds and not more than 3600 seconds.

Figure 3:
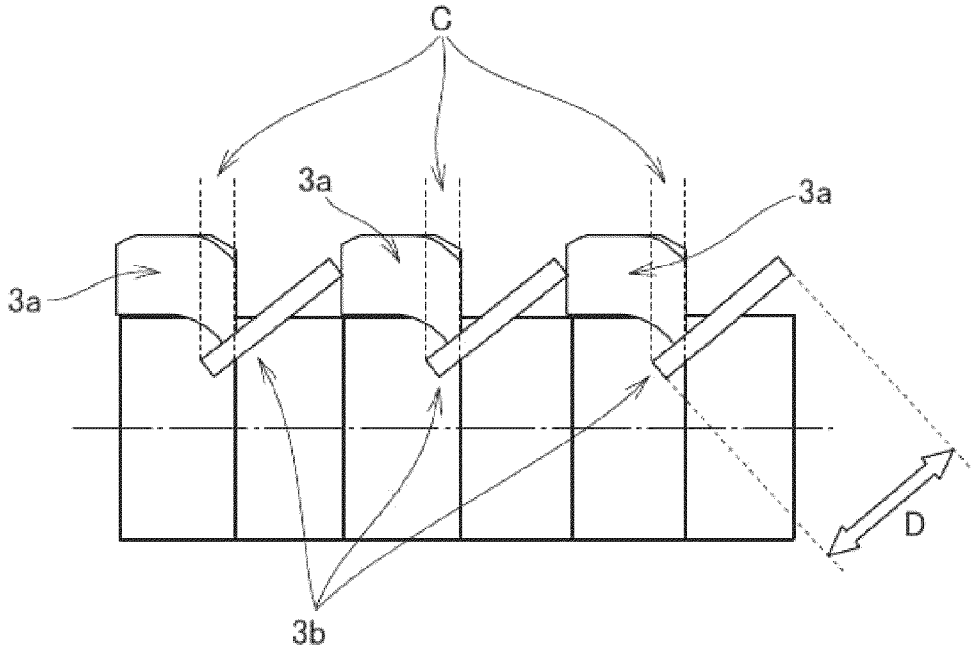
FIG. 3 is a schematic diagram that shows one example of the positional relationship among the stirring members used in a coating processing apparatus that can be used in the magnetic carrier production method of the present invention.

In a preferred embodiment of the coating processing apparatus used in the present invention, as shown in FIG. 3 there is a direct overlap between a stirring member 3*a* at the rotating member top and a stirring member 3*b* at the rotating member middle and a positional relationship obtains in which the stirring member 3*a* and the stirring member 3*b* overlap by a width C.

Viewed from the standpoint of realizing the ordered mixture referenced above, in an embodiment of the coating processing apparatus used in the present invention the relationship between the overlap width C and the maximum width D of the stirring member 3 satisfies the following formula (1).

$$0.05 \leq C/D \leq 0.50 \quad (1)$$

Also viewed from the standpoint of realizing the ordered mixture, and when A represents the volume of the processed material (magnetic carrier core and resin composition particles) and B represents the spatial volume of the minimum gap 18 between the inner circumferential surface of the main casing 1 and the stirring members 3, the relationship between A and B satisfies the following formula (2) in an embodiment of the coating processing apparatus used in the present invention.

$$1.1 \leq A/B \leq 4.0 \quad (2)$$

Figure 4:
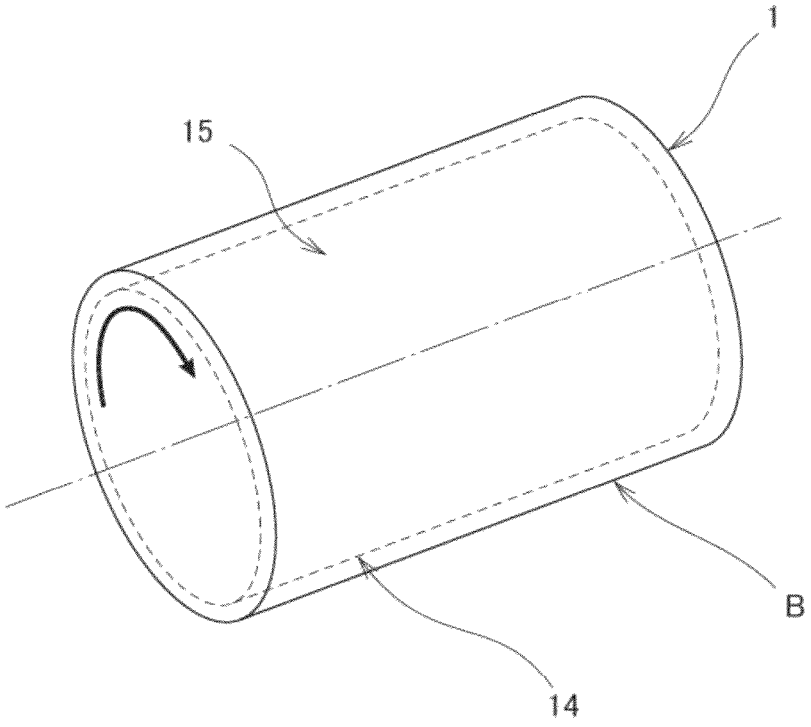
FIG. 4 is a schematic diagram that shows the spatial volume of the minimum gap between the stirring members and the inner circumferential surface of the main casing, for a coating processing apparatus that can be used in the magnetic carrier production method of the present invention.

The spatial volume B of the minimum gap 18 between the inner circumferential surface of the main casing 1 and the stirring members 3 refers, as shown in FIG. 4, to the spatial volume provided by subtracting, from the volume within the main casing 1, the rotational volume 15 calculated from the outermost end locus 14 of the stirring members 3 that can be associated with the rotation of the rotating member 2.

In an embodiment of the coating processing apparatus used in the present invention, the minimum gap 18 between the main casing 1 and the stirring member 3 is preferably at least 0.5 mm and not more than 30.0 mm and is more preferably at least 1.0 mm and not more than 20.0 mm.

The magnetic carrier yielded by the production method of the present invention preferably has a volume-based 50% particle diameter (D50) of at least 20 μm and not more than 100 μm because this provides an optimized density for the magnetic brush at the development pole, can generate a sharp distribution for the amount of toner charge, and can provide a higher image quality. The range at least 25 μm and not more than 60 μm is more preferred.

Viewed from the standpoint of imparting charge to the toner, the magnetic carrier provided by the production method of the present invention preferably has an average circularity of at least 0.920 and more preferably of at least 0.950.

Magnetic carrier particles with a circularity less than or equal to 0.900 are preferably not more than 5.0 number % in the number-based circularity distribution of the magnetic carrier provided by the production method of the present invention. A magnetic carrier with a circularity less than or equal to 0.900 in the circularity distribution is an amorphous particle and in particular is a particle produced by, for example, cracking, chipping, or aggregation, and as a rule refers to a magnetic carrier that is not uniformly coated.

The magnetic carrier core is described in the following.

A known magnetic carrier core, e.g., ferrite, magnetite, or a resin carrier core in which a magnetic body is dispersed, can be used as the magnetic carrier core.

Specific examples are magnetic ferrites that contain one or two or more elements selected from iron, lithium, beryllium, magnesium, calcium, rubidium, strontium, nickel, cobalt, manganese, chromium, and titanium, as well as magnetite. Among these, magnetic ferrites having at least one or two or more elements selected from manganese, calcium, lithium, and magnesium, and magnetite have a low specific gravity and are therefore preferred.

Suitable examples of the magnetic ferrite are iron oxides such as Ca—Mg—Fe ferrites, Li—Fe ferrites, Mn—Mg—Fe ferrites, Mn—Mg—Sr—Fe ferrites, Li—Mg—Fe ferrites, Li—Ca—Mg—Fe ferrites, and Li—Mn—Fe ferrites.

These iron oxide ferrites are obtained by the dry or wet mixing of the oxide, carbonate, or nitrate of the respective metals and presintering to provide the desired ferrite composition. The obtained iron oxide ferrite is then pulverized to the submicron level. In order to adjust the presintered ferrite to a particle diameter of about at least 0.1 μm and not more than 10.0 μm, at least 20 mass % and not more than 50 mass % water is added and wet grinding is carried out.

A slurry is prepared by the addition of at least 0.1 mass % and not more than 10 mass % of, for example, a polyvinyl alcohol (molecular weight at least 500 and not more than 10,000), as a binder resin.

The ferrite core can be obtained by granulating this slurry using a spray dryer and carrying out the main sintering.

On the other hand, the aforementioned resin carrier core in which a magnetic body is dispersed can be obtained by carrying out the polymerization, in the presence of a magnetic body, of monomer for forming the binder resin in the resin carrier core in which a magnetic body is dispersed. This monomer for forming the binder resin can be exemplified by the following:

vinyl monomers; bisphenols and epichlorohydrin for forming an epoxy resin; phenols and aldehydes for forming phenolic resins; urea and aldehydes for forming urea resins; and melamine and aldehydes.

Particularly preferred among the preceding are phenols and aldehydes.

In this case, the resin carrier core in which a magnetic body is dispersed can be produced by adding the magnetic body, a phenol, and an aldehyde to an aqueous medium and carrying out polymerization of the phenol and aldehyde in the aqueous medium in the presence of a basic catalyst.

In addition to phenol (hydroxybenzene), the phenol for forming the phenolic resin may be any compound having a phenolic hydroxyl group.

These compounds having a phenolic hydroxyl group can be exemplified by m-cresol, p-tert-butylphenol, o-propylphenol, and resorcinol. Other examples are alkylphenols such as bisphenol A and halogenated phenols provided by the substitution of all or part of the hydrogen in an aromatic ring (for the example, the benzene ring) or the hydrogen in an alkyl group by the chlorine atom or bromine atom.

On the other hand, the aldehyde for forming a phenolic resin is preferably formaldehyde in either the formalin or paraformaldehyde form or furfural, while formaldehyde is more preferred.

The molar ratio of the aldehyde versus the phenol is preferably 1:1 to 1:4 and more preferably 1:1.2 to 1:3.

When the molar ratio of the aldehyde versus the phenol is greater than 1:1, particle production is impeded or, even when this production occurs, curing of the resin progresses poorly and the produced particles tend to have little strength.

On the other hand, when the molar ratio of the aldehyde versus the phenol is smaller than 1:4, the unreacted aldehyde remaining in the aqueous medium post-reaction tends to increase. Condensation between the phenol and aldehyde can be carried out using a basic catalyst.

The basic catalyst may be a catalyst as used in the production of ordinary resol resins, and the basic catalyst can be exemplified by aqueous ammonia, hexamethylenetetramine, and alkylamines such as dimethylamine, diethyltriamine, and polyethyleneimine.

The molar ratio of these basic catalysts versus the phenol is preferably 1:0.02 to 1:0.30.

The volume-based 50% particle diameter (D50) of the magnetic carrier core is preferably in the range at least 19.5 μm and not more than 99.5 μm and is more preferably in the range at least 24.5 μm and not more than 59.5 μm.

The resin composition used in the present invention to coat the magnetic carrier core surface is described below. The resin composition used in the present invention contains at least a resin component. A thermoplastic resin is preferably used as the resin component. The resin component may be a single resin or a combination of two or more resins.

The thermoplastic resin used for the resin component can be exemplified by polystyrene; acrylic resins such as polymethyl methacrylate and styrene-acrylic acid copolymers; styrene-butadiene copolymers; ethylene-vinyl acetate copolymers; polyvinyl chloride; polyvinyl acetate; polyvinylidene fluoride resins; fluorocarbon resins; perfluorocarbon resins; solvent-soluble perfluorocarbon resins; polyvinyl alcohol; polyvinyl acetal; polyvinylpyrrolidone; petroleum resins; celluloses; cellulose derivatives such as cellulose acetate, cellulose nitrate, methyl cellulose, hydroxymethyl cellulose, hydroxyethyl cellulose, and hydroxypropyl cellulose; novolac resins; low molecular weight polyethylene; polyester resins such as saturated alkylpolyester resins, polyethylene terephthalate, polybutylene terephthalate, and polyarylates; polyamide resins; polyacetal resins; polycarbonate resins; polyethersulfone resins; polysulfone resins; polyphenylene sulfide resins; and polyetherketone resins.

In the present invention, the glass-transition temperature (Tg), measured using a differential scanning calorimeter, of the resin component present in the resin composition is preferably at least 70° C. and not more than 130° C. This glass-transition temperature is preferably in the indicated range because this can provide an excellent adhesiveness with the magnetic carrier core, prevent peeling of the coat layer, and provide a suitable abrasion.

In the present invention, the amount of resin composition coated with reference to the magnetic carrier core is preferably at least 1.5 mass parts and not more than 10.0 mass parts of the resin composition per 100.0 mass parts of the magnetic carrier core based on environmental stability and preventing residual resin composition particles.

In addition, in the present invention the weight-average molecular weight Mw of the tetrahydrofuran (THF)-soluble matter in the resin component in the resin composition is preferably at least 100,000 and not more than 2,000,000 from the standpoint of the adhesiveness of the coat layer and a suitable abrasiveness.

In the present invention, the volume-based 50% particle diameter (D50) of the resin composition particles used in the coating process step is preferably at least 0.1 μm and not more than 15.0 μm, more preferably at least 0.1 μm and not more than 5.0 μm, and even more preferably at least 0.3 μm and not more than 3.0 μm.

The method of producing the resin composition particles can be exemplified by methods in which the particles are directly obtained by, for example, suspension polymerization or emulsion polymerization, and methods in which the particles are produced while removing the solution by, for example, spray drying, after the particles have been synthesized by solution polymerization.

The toner used in the present invention is described in the following. The toner used in combination with the magnetic carrier of the present invention can be a known toner and may be a toner produced by any method such as a pulverization method, polymerization method, emulsion aggregation method, dissolution suspension method, and so forth.

An example of an embodiment of the toner used in the present invention is a toner that has a toner particle that contains a binder resin, a wax, and a colorant.

A resin as used in ordinary toners can be used for the binder resin constituent of this toner.

Specific examples are polystyrene; homopolymers of substituted styrenes, such as poly-p-chlorostyrene and polyvinyltoluene; styrenic copolymers such as styrene-p-chlorostyrene copolymers, styrene-vinyltoluene copolymers, styrene-vinylnaphthalene copolymers, styrene-acrylate ester copolymers, styrene-methacrylate ester copolymers, styrene-methyl α-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, and styrene-acrylonitrile-indene copolymers; as well as polyvinyl chloride, phenolic resins, natural modified phenolic resins, natural resin-modified maleic acid resins, acrylic resins, methacrylic resins, polyvinyl acetate, silicone resins, polyester resins, polyurethane, polyamide resins, furan resins, epoxy resins, xylene resins, polyvinyl butyral, terpene resins, coumarone-indene resins, and petroleum resins.

With regard to toner properties arising from the binder resin, in a more preferred case the molecular weight distribution of the tetrahydrofuran (THF)-soluble matter measured by gel permeation chromatography (GPC) has at least one peak in the molecular weight region at least 2,000 and not more than 50,000 and the component with a molecular weight at least 1,000 and not more than 30,000 is present at at least 50% and not more than 90%.

The toner used in the present invention preferably contains a wax from the standpoint of improving the releasability from the fixing member during fixing and improving the fixing performance.

This wax can be exemplified by paraffin wax and derivatives thereof, microcrystalline wax and derivatives thereof, Fischer-Tropsch waxes and derivatives thereof, polyolefin waxes and derivatives thereof, and carnauba wax and derivatives thereof.

These wax derivatives encompass the oxides, block copolymers with vinyl monomers, and graft modifications.

The wax is preferably used in a microparticulate form in the case of pulverized toners. In the case of the internal addition of these waxes to the toner particle, the addition to the toner particle of at least 1.0 mass part and not more than 20.0 mass parts per 100.0 mass parts of the binder resin is preferred.

In order to control the amount of toner charge and the toner charge distribution, the toner used in the present invention may use a control agent, either incorporated within the toner particle (internal addition) or mixed with the toner particles (external addition).

Negative charge control agents for controlling the toner to a negative charge can be exemplified by organometal complexes and chelate compounds. The organometal complexes can be exemplified by monoazo-metal complexes, acetylacetone-metal complexes, aromatic hydroxycarboxylic acid-metal complexes, and aromatic dicarboxylic acid-metal complexes.

The negative charge control agents can be further exemplified by aromatic hydroxycarboxylic acids, aromatic monocarboxylic acids, and aromatic polycarboxylic acids and their metal salts; the anhydrides of aromatic hydroxycarboxylic acids, aromatic monocarboxylic acids, and aromatic polycarboxylic acids; and the ester compounds of aromatic hydroxycarboxylic acids, aromatic monocarboxylic acids, and aromatic polycarboxylic acids, and phenol derivatives, e.g., bisphenol derivatives.

Positive charge control agents for controlling the toner to a positive charge can be exemplified by nigrosine and modifications of nigrosine by fatty acid metal salts; quaternary ammonium salts such as tributylbenzylammonium 1-hydroxy-4-naphthosulfonate and tetrabutylammonium tetrafluoroborate, and their lake pigments; phosphonium salts such as tributylbenzylphosphonium 1-hydroxy-4-naphthosulfonate and tetrabutylphosphonium tetrafluoroborate, and their lake pigments; triphenylmethane dyes and their lake pigments (the laking agent can be exemplified by phosphotungstic acid, phosphomolybdic acid, phosphotungstomolybdic acid, tannic acid, lauric acid, gallic acid, ferricyanide, and ferrocyanide); and the metal salts of higher fatty acids.

A single one of these charge control agents may be used or two or more may be used in combination. A charge control resin may also be used, and it may also be used in combination with these charge control agents.

The above-described charge control agents are preferably used in a microparticulate form. In the case of the internal addition of these charge control agents to the toner particle, preferably at least 0.1 mass parts and not more than 10.0 mass parts per 100.0 mass parts of the binder resin is added to the toner particle.

The various heretofore known colorants can be used in the toner used by the present invention. Among these colorants, the black colorant can be exemplified by magnetite, carbon black, and combinations of chromatic colorants, e.g., the yellow colorants, magenta colorants, and cyan colorants given below, that have been adjusted to black.

Compounds as typified by condensed azo compounds, isoindolinone compounds, anthraquinone compounds, azo-metal complexes, methine compounds, and allylamide compounds can be used as the yellow colorant. Specific examples are C.I. Pigment Yellow 12, 13, 14, 15, 17, 62, 74, 83, 93, 94, 95, 97, 109, 110, 111, 120, 127, 128, 129, 147, 155, 162, 168, 174, 176, 180, 181, 185, and 191.

Condensed azo compounds, diketopyrrolopyrrole compounds, anthraquinone, quinacridone compounds, basic dye lake compounds, naphthol compounds, benzimidazolone compounds, thioindigo compounds, and perylene compounds can be used as the magenta colorant. Specific examples are C.I. Pigment Red 2, 3, 5, 6, 7, 23, 31, 48:2, 48:3, 48:4, 57:1, 81:1, 122, 144, 146, 150, 166, 169, 177, 184, 185, 202, 206, 220, 221, 238, and 254.

Copper phthalocyanine compounds and their derivatives, anthraquinone compounds, and basic dye lake compounds can be used as the cyan colorant. Specific examples are C.I. Pigment Blue 1, 7, 15, 15:1, 15:2, 15:3, 15:4, 60, 62, and 66.

A single one of these colorants or a mixture of them may be used, and these colorants may also be used in the form of a solid solution. The colorant is selected in the present invention based on a consideration of the hue angle, chroma, lightness, weather resistance, OHP transparency, and dispersibility in the toner.

A nonmagnetic colorant in these chromatic colors is preferably added to the toner particles at at least 1.0 mass part and not more than 20.0 mass parts as the total amount with reference to 100.0 mass parts of the binder resin.

In addition, a magnetic colorant is preferably added to the toner particles at at least 20.0 mass parts and not more than 60.0 mass parts as the total amount with reference to 100.0 mass parts of the binder resin.

A microparticulate external additive may be externally added to the toner used in the present invention. The flowability and transferability can be improved by the external addition of microparticles.

The external additive externally added to the toner particle surface preferably contains any selection from titanium oxide microparticles, alumina microparticles, and silica microparticles.

An excellent charging performance and an excellent flowability can be imparted by such microparticles that have a specific surface area, as measured by nitrogen adsorption by the BET method, of at least 20 $m^2/g$ and preferably at least 50 $m^2/g$. The surface of the microparticles present in the external additive has preferably been subjected to a hydrophobic treatment. This hydrophobic treatment is preferably carried out using any of various coupling agents, e.g., titanium coupling agents, silane coupling agents; a fatty acid or metal salt thereof; a silicone oil; or a combination of the preceding.

Moreover, as one of the microparticles, the addition is preferred of microparticles that have a number-average particle diameter of at least 80 nm and not more than 300 nm because this can lower the attachment force to the magnetic carrier and enables efficient development even when the toner has a high charge.

The material of the microparticle can be exemplified by silica, alumina, titanium oxide, cerium oxide, and strontium titanate.

In the case of silica, any silica produced using a heretofore known technology, for example, gas-phase decomposition methods, combustion methods, and deflagration methods, can be used. Among these, silica obtained by a sol-gel method, which can provide a sharp particle diameter distribution, is preferred.

The external additive content in the toner is preferably at least 0.1 mass parts and not more than 5.0 mass parts per 100.0 mass parts of the toner. In addition, the external additive may be a combination of a plurality of microparticle types.

Viewed in terms of achieving an excellent developing performance, preventing fogging, and preventing scattering, the mixing ratio, expressed as the toner concentration in the developer, when a two-component developer is prepared by mixing a toner with the magnetic carrier of the present invention is preferably at least 2 mass % and not more than 15 mass % and preferably at least 4 mass % and not more than 13 mass %.

The measurement methods associated with the present invention are described in the following.

<Method for Measuring the Apparent Density ($g/cm^3$) of the Resin Composition Particles>

The measurement of the apparent density ($g/cm^3$) of the resin composition particles is carried out using a Powder Tester PT-R (Hosokawa Micron Corporation) in a 23° C./50% RH measurement environment.

While being vibrated at a 1 mm vibration amplitude using a screen with an aperture of 150 μm, the resin composition particles are collected in a metal cup with a volume of 100 $cm^3$; leveling is performed to provide precisely 100 $cm^3$; and the apparent density ($g/cm^3$) is measured from the mass collected in the metal cup.

<Method for Measuring the Apparent Density ($g/cm^3$) of the Magnetic Carrier Core>

The apparent density ($g/cm^3$) of the magnetic carrier core is measured using a JIS-Z-204-2000 For Metal Powder JIS Apparent Density Measurement Instrument (Tsutsui Scientific Instruments Co., Ltd.) and using a 23° C./50% RH measurement environment.

Using a funnel with an orifice diameter of 2.5 mmΦ, the magnetic carrier core is collected in a metal cup with a volume of 25 $cm^3$; leveling is performed to provide precisely 25 $cm^3$; and the apparent density ($g/cm^3$) is measured from the mass collected in the metal cup.

<Method for Measuring the Glass-transition Temperature (Tg) of the Resin Component Present in the Resin Composition>

The glass-transition temperature (Tg) of the resin component present in the resin composition is measured based on ASTM D3418-82 using a "Q1000" differential scanning calorimeter (TA Instruments, Inc.).

Temperature correction in the instrument detection section is carried out using the melting points of indium and zinc, while the heat of fusion of indium is used to correct the amount of heat.

Specifically, approximately 10 mg of the resin composition is precisely weighed out and introduced into an aluminum pan. Using an empty aluminum pan as the reference, the measurement is performed at a ramp rate of 10° C./min in the measurement temperature range from 30 to 200° C.

The change in the specific heat in the temperature range from 40° C. to 150° C. is obtained in this temperature ramp-up process. Here, the glass-transition temperature (Tg) of the resin component in the resin composition is taken to be the intersection between the differential heat curve and the line for the midpoint between the baseline prior to the appearance of the specific heat change and the baseline after the appearance of the specific heat change.

<Area % of the Region Originating with Metal Oxide on the Magnetic Carrier Surface>

Figure 6A:
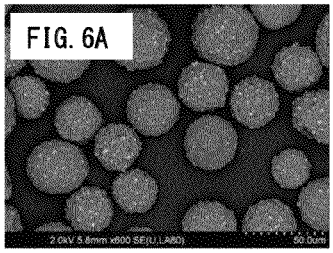
FIG. 6A is an example of a projection diagram in which mainly backscattered electrons are visualized, at a magnification of 600×, of a model sample of the magnetic carrier for the purpose of describing the method of calculating the area % of the region originating with the metal oxide on the magnetic carrier surface in an evaluation of the surface state of the magnetic carrier of the present invention.

The area % of the region originating with metal oxide on the particle surface of the magnetic carrier of the present invention can be determined by observation of the backscattered electron image with a scanning electron microscope followed by image processing (FIG. 6A).

The area % originating with metal oxide on the magnetic carrier surface used in the present invention is determined using an S-4800 scanning electron microscope (SEM) (Hitachi, Ltd.).

The area % originating with metal oxide is calculated by performing image processing on the projection image that visualizes the backscattered electrons and that is obtained using this scanning electron microscope and an acceleration voltage of 2.0 kV.

It is known that, in observations with a scanning electron microscope, the amount of backscattered electrons emitted from a sample is greater for heavier elements.

For a sample that has a resin region and a metal oxide region that originates with a magnetic carrier core, as is the case for the magnetic carrier surface in the present invention, the metal oxide region is seen as bright (high brightness, white) and the resin region is seen as dark (low brightness, black), and as a consequence an image is obtained that has a large contrast difference therebetween. Specifically, the carrier particles are fixed as a single layer with carbon tape on the sample stub for electron microscopic observation and the observation is carried out using the following conditions without vapor deposition with platinum. The observation is performed after a flashing procedure.

[Observation Conditions]
Signal Name=SE (U, LA80)
Accelerating Voltage=2000 Volt
Emission Current=10000 nA
Working Distance=6000 μm
Lens Mode=High
Condenser1=5
Scan Speed=Slow4 (40 seconds)
Magnification=600
Data Size=1280×960
Color Mode=Grayscale For the backscattered electron image, the brightness is adjusted to "contrast 5, brightness-5" on the control software for the S-4800 scanning electron microscope. Then, the projection image of the magnetic carrier (FIG. 6A) is obtained as an 8-bit 256-gradation grayscale image with an image size of 1280×960 pixels using "Slow4 (40 seconds)" for the capture speed/number of frame integration.

Using the scale on the image, the length of 1 pixel is then 0.1667 μm and the area of 1 pixel is 0.0278 $\mu m^2$.

Using the obtained backscattered electron projection image, the area % of the region originating with metal oxide is subsequently calculated for 50 magnetic carriers.

The details of the method for selecting the 50 magnetic carriers that undergo the analysis are described below. Image-Pro Plus5.1J (Media Cybernetics, Inc.) image processing software is used for the area % of the region originating with metal oxide.

Figure 6B:
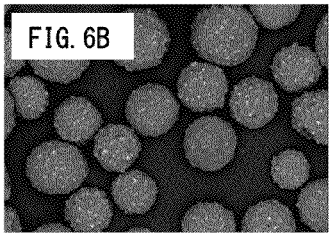
FIG. 6B is an example of a diagram that shows the state, for a model sample of the magnetic carrier, after pre-processing in the image processing of a projection image that visualizes mainly backscattered electrons.

First, image processing is not required for the character string at the bottom of the image in FIG. 6A and the unnecessary area is deleted and the image is cropped to a size of 1280×895 (FIG. 6B).

Figure 6C:
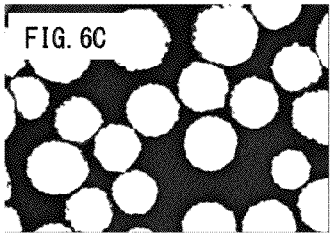
FIG. 6C is an example of a diagram that shows the state in which, for a model sample of the magnetic carrier, the magnetic carrier particles have been extracted from a projection image that visualizes mainly backscattered electrons.

Then, the magnetic carrier region is extracted and the size of the extracted magnetic carrier region is counted. Specifically, in order to extract the magnetic carrier undergoing analysis, the background region is first isolated from the magnetic carrier. "Measurement"–"Count/Size" is selected in the Image-Pro Plus 5.1J. The brightness range is set to a range of 50 to 255 using the "Brightness Range Selection" of "Count/Size" and the unwanted low-brightness carbon tape region is eliminated as background and extraction of the magnetic carrier is performed (FIG. 6C).

When the magnetic carrier has been fixed by a method other than carbon tape, the background may then not necessarily be a low-brightness region, or the possibility that the background assumes a brightness that to some degree is the same as the magnetic carrier cannot be excluded.

However, discrimination can be easily performed from the backscattered electron projection image at the boundary between the magnetic carrier and the background.

When the extraction is performed, 4 links is selected, smoothness 5 is input, and a check is entered in gap filling in the extraction options of "Count/Size" and particles located on any boundary (periphery) of the image and particles overlapping with another particle are excluded from the calculation.

Figure 6D:
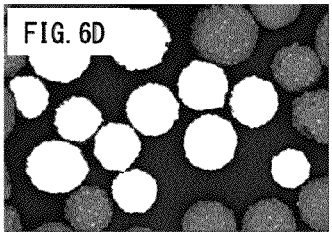
FIG. 6D is an example of a diagram that shows the state in which, for a model sample of the magnetic carrier, the carrier particles in the periphery of the image have been excluded from the magnetic carrier particles that have been extracted from a projection image that visualizes mainly backscattered electrons.

Then, in the measurement items in "Count/Size", area and Feret diameter (average) are selected and the area selection range is set to a minimum of 300 pixels and a maximum of 10,000,000 pixels (FIG. 6D).

Figure 6E:
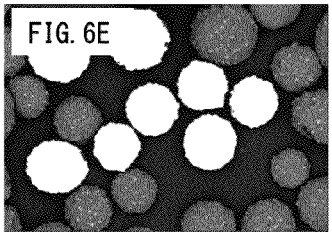
FIG. 6E is an example of a diagram that shows the state in which the image-processed particles are narrowed down further based on particle diameter from the magnetic carrier selected in FIG. 6B.
Figure 6F:
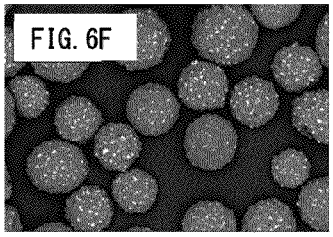
FIG. 6F is an example of a diagram that—for a model sample of the magnetic carrier for the purpose of describing the method of calculating the area % of the region originating with the metal oxide on the magnetic carrier surface in an evaluation of the surface state of the magnetic carrier of the present invention—describes the state in which the metal oxide on the magnetic carrier particles has been extracted (all are photographs in lieu of drawings)

In addition, for the Feret diameter (average), the selection range is set to provide a diameter range that is ±25% of the measured value of the volume distribution-based 50% particle diameter (D50) of the magnetic carrier, vide infra, and the magnetic carrier particles undergoing image analysis are extracted (FIG. 6E).

The size (ja) (number of pixels) of the region originating with an extracted magnetic carrier, the sum of the individual extracted regions ($\Sigma ja=Ja$), and the number of regions extracted (Jc) are determined.

The same procedure is repeated on magnetic carrier projection images in different fields until the number of extracted magnetic carriers Jc reaches Jc=50.

Figure 7:
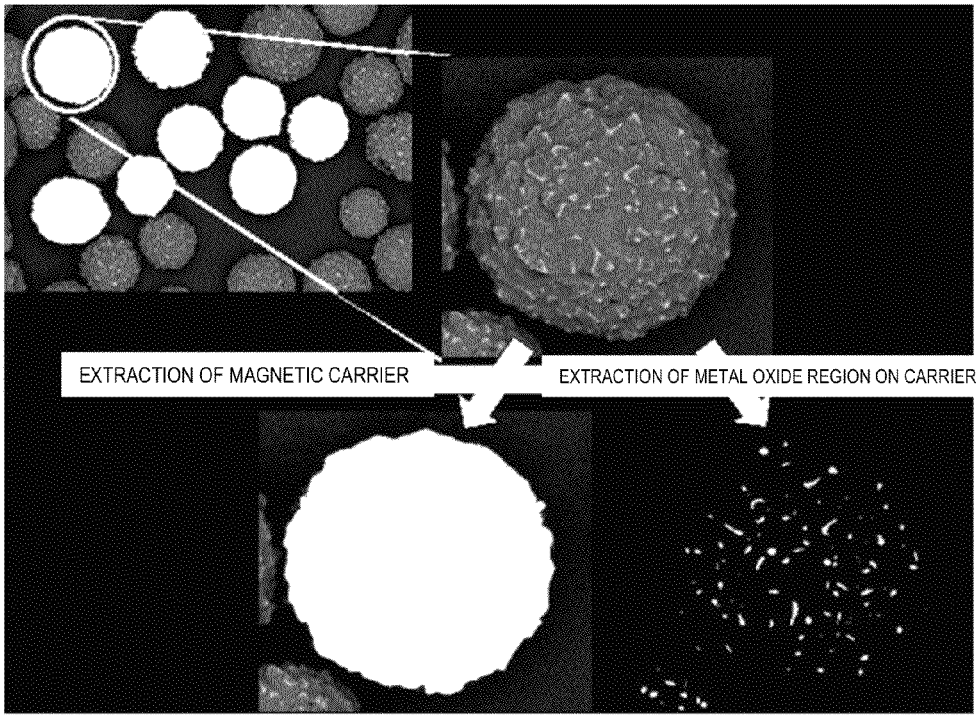
FIG. 7 is a schematic diagram in order to describe the image processing procedure in the present invention (photograph in lieu of drawing).

Then, the region originating with metal oxide is extracted from the selected magnetic carriers. The brightness range is set to the range of 140 to 255 in the "Brightness Range Selection" of "Count/Size" of the Image-Pro Plus 5.1J and extraction of the high-brightness regions on the magnetic carrier is performed. The area selection range is set to a minimum of 10 pixels and a maximum of 10,000 pixels and the region originating with metal oxide on the magnetic carrier surface is extracted (FIG. 7).

As in the extraction of the magnetic carrier region described above, the particles located at the outer periphery of the image and particles deviating from the diameter range that is ±25% of the measured value of the 50% particle diameter (D50) are excluded from the calculations.

The calculation is performed using the following formula and using the size (ma) (number of pixels) of the extracted region originating with metal oxide and the sum of the individual extracted regions (Ma). area % of the region originating with metal oxide=Ma/Ja×100

<Method for Measuring the Volume-based 50% Particle Diameter (D50) of the Magnetic Carrier and the Magnetic Carrier Core>

The particle diameter distribution is measured using a "Microtrac MT3300EX" (Nikkiso Co., Ltd.) laser diffraction/scattering particle size distribution analyzer.

The measurement of the volume-based 50% particle diameter (D50) is carried out on the magnetic carrier and the magnetic carrier core with a dry measurement sample feeder installed.

For example, a "One-Shot Dry Sample Conditioner Turbotrac" (Nikkiso Co., Ltd.) is used as this dry measurement sample feeder.

The feed conditions with the Turbotrac were as follows: a dust collector was used as the vacuum source; the air current flow was approximately 33 liter/sec; and the pressure was approximately 17 kPa. Control is carried out automatically with the software.

The 50% particle diameter (D50) that is the cumulative value on a volume basis is determined for the particle diameter. Control and analysis are performed using the provided software (version 10.3.3-202D).

The measurement conditions are as follows.

SetZero time: 10 seconds
measurement time: 10 seconds
number of measurements: 1
particle refractive index: 1.81
particle shape: nonspherical
measurement upper limit: 1408 μm
measurement lower limit: 0.243 μm
measurement environment: normal temperature, normal humidity environment (23° C., 50% RH)

<Method for Measuring the Volume-based 50% Particle Diameter (D50) of the Resin Composition Particles and the Volume % of Particles≥10.0 μm>

A "Microtrac MT3300EX" (Nikkiso Co., Ltd.) laser diffraction/scattering particle size distribution analyzer is used to measure the volume-based 50% particle diameter (D50) of the resin composition particles and the volume % of particles 10.0 μm. The measurement is carried out with a "Sample Delivery Control (SDC)" (Nikkiso Co., Ltd.) wet-type sample circulator installed. Ion-exchanged water was circulated and the resin composition particles were added dropwise to the sample circulator to give the measurement concentration. A flow rate of 70%, an ultrasound output of 40 W, and an ultrasound time of 60 seconds were used. Control and the calculation of D50 are carried out automatically by the software at the conditions indicated below. The 50% particle diameter (D50) that is the cumulative value on a volume basis is determined for the particle diameter and the volume % of particles ≥10 μm is also determined.

The measurement conditions are as follows.

SetZero time: 10 seconds
measurement time: 30 seconds
number of measurements: 10
solvent refractive index: 1.33
particle refractive index: 1.50
particle shape: nonspherical
measurement upper limit: 1408 μm
measurement lower limit: 0.243 μm
measurement environment: normal temperature, normal humidity environment (23° C./50% RH)

<Method for Measuring the Molecular Weight of the Resin Component (or Resin Composition Microparticles) Present in the Resin Composition>

The molecular weight of the resin component (or resin composition microparticles) present in the resin composition is measured as follows by gel permeation chromatography (GPC) using the molecular weight distribution of the tetrahydrofuran (THF)-soluble matter.

Tetrahydrofuran (THF) is run at a flow rate of 0.35 mL per minute in a column stabilized in a 40° C. heated chamber and the measurement is carried out by injecting 10 μL of a THF sample solution provided by adjusting the sample concentration to 20 to 30 mg in 5 mL THF. An RI (refractive index) detector is used for the detector. In order to accurately measure the molecular weight region less than or equal to $2\times10^7$, a column is used that is a combination of a plurality of commercially available polystyrene gel columns. The measurement is performed in the present invention using a combination of two TSKgel SuperMultiporeHZ-H columns.

With regard to the measurement of the molecular weight, the molecular weight distribution exhibited by the sample is calculated from the relationship between the logarithmic value and number of counts for a calibration curve constructed using a plurality of monodisperse polystyrene standard samples. Polystyrene High EasiVials (2 mL) from VARIAN (Polymer Laboratories) are used as the standard polystyrene samples for construction of the calibration curve.

<Method for Measuring the Average Circularity of the Magnetic Carrier, the Proportion of Magnetic Carrier Having a Circularity Less than or Equal to 0.900 In the Circularity Frequency Distribution, and The Residual Resin Composition in the Magnetic Carrier>

The average circularity of the magnetic carrier, the proportion of magnetic carrier having a circularity less than or equal to 0.900 in the circularity frequency distribution, and the residual resin composition are measured with an "FPIA-3000" flow particle image analyzer (Sysmex Corporation).

The specific measurement method is as follows. To 20 mL ion-exchanged water in a beaker are added a suitable amount of a surfactant, preferably an alkylbenzenesulfonate salt, as a dispersing agent and then 0.3 g of the measurement sample.

A dispersion treatment is subsequently carried out for 2 minutes using a benchtop ultrasound cleaner/disperser having an oscillation frequency of 50 kHz and an electrical output of 150 W (for example, a "VS-150" from Velvo-Clear Co., Ltd.) to give a dispersion for submission to measurement.

Cooling is carried out here as appropriate so as to provide a dispersion temperature of at least 10° C. and no more than 40° C. The average circularity of the magnetic carrier is measured using the above-described flow particle image analyzer equipped with a standard objective lens (10×).

The dispersion prepared according to the above-described procedure is introduced into the flow particle image analyzer and 500 magnetic carriers are measured in total count mode in HPF measurement mode. For the measurement, the binarization threshold value during particle analysis is set to 85%; the particle diameter limits are set to a circle-equivalent diameter (number basis) of at least 19.92 μm and not more than 200.00 μm in order to exclude excess particles from the measurement range; and the average circularity of the magnetic carrier is then determined.

"PSE-900A" particle sheath (Sysmex Corporation) is used for the sheath fluid.

In the measurement of the proportion of magnetic carrier having a circularity less than or equal to 0.900 in the circularity frequency distribution, the particle diameter limits are set to a circle-equivalent diameter (number basis) of at least 19.92 μm and not more than 200.00 μm in order to exclude excess particles from the measurement range.

In addition, the measurement is carried out using at least 0.200 and not more than 0.900 for the particle shape limits, and the number of particles having an average circularity less than or equal to 0.900 is determined for the magnetic carrier core and the magnetic carrier.

The occurrence rate was calculated by dividing the number of particles less than or equal to 0.900 by the number of particles with any circularity (circularity at least 0.200 and not more than 1.000).

For the measurement of the residual resin composition in the magnetic carrier, the measurement is carried out with the particle diameter limits set to a circle-equivalent diameter (volume basis) of at least 0.50 μm and not more than 19.92 μm and setting the particle shape limits to at least 0.200 and not more than 1.000, and the occurrence rate of particles other than the magnetic carrier is then measured as the residual resin composition.

For this measurement, automatic focal point adjustment was performed prior to the start of the measurement using reference latex particles (for example, a dilution with ion-exchanged water of 5200A from Duke Scientific). After this, focal point adjustment is performed every two hours after the start of measurement.

The present invention can provide a production method that can uniformly carry out a coating process on the magnetic carrier core surface and within the coat layer when the magnetic carrier core surface is coated by resin composition particles by a dry coating process. The present invention can also provide a magnetic carrier that exhibits an excellent timewise stability whereby a decline in the amount of charge on the toner after standing is suppressed even in the presence of high temperatures and high humidities.

EXAMPLES

The present invention is more particularly described below through specific production examples and working examples, but the present invention is in no way limited by or to these. The number of parts and % in the specific production examples and working examples, unless specifically indicated otherwise, are on a mass basis in all instances.

<Magnetic Carrier Core Production Example>

$Fe_2O_3$: 64.0 mass %

$MnCO_3$: 31.3 mass %

$Mg(OH)_2$: 4.7 mass %

These materials were ground and mixed for 3 hours in a dry ball mill using zirconia balls (10 mmϕ). After the grinding and mixing, sintering is performed for 2 hours at 950° C. in the air using a burner-type sintering oven to produce a presintered ferrite.

The obtained presintered ferrite is ground to approximately 0.5 mm using a crusher; 30 mass parts of water is then added per 100 mass parts of the presintered ferrite; and grinding is carried out for 4 hours in a wet bead mill using zirconia beads (1.0 mmϕ) to obtain a ferrite slurry.

The following are added to the obtained slurry, per 100.0 mass parts of the presintered ferrite, and granulation into spherical particles is performed using a spray dryer (Ohkawara Kakohki Co., Ltd.).

$SiO_2$ particles: 5.0 mass parts (volume-based 50% particle diameter (D50): 1.0 μm)

polyvinyl alcohol: 2.0 mass parts

The obtained granulate was sintered for 4 hours at 1100° C. in an electric furnace under a nitrogen atmosphere (oxygen concentration: 0.5 volume %) to obtain a sinter. This sinter was pulverized; the coarse particles were removed by sieving with a sieve having an aperture of 250 μm; and the nonmagnetic material was removed by performing a magnetic selection to obtain a magnetic carrier core.

The obtained magnetic carrier core had a volume-based 50% particle diameter (D50) of 35 μm and an apparent density of 2.1 g/cm$^3$.

<Resin Composition Particle Production Example 1>

1200.0 mass parts of ion-exchanged water and 36.0 mass parts of polyvinyl alcohol as a dispersion stabilizer are introduced into a four-neck separable flask equipped with a stirrer, condenser, thermometer, and nitrogen inlet tube.

This is followed by the introduction of 400.0 mass parts of methyl methacrylate (MMA) monomer, 100.0 mass parts of cyclohexyl methacrylate (CHMA) monomer, and 3.0 mass parts of azobisisovaleronitrile as polymerization initiator. Dispersion to uniformity was carried out using a TK Homomixer (Tokushu Kika Kogyo Co., Ltd.) at 12,000 rpm.

While in this state, the temperature was raised to 65° C. while stirring under nitrogen introduction and a polymerization reaction was run for 12 hours at 65° C. to obtain a polymerization solution. After the end of the polymerization reaction, the remaining monomer was distilled out under reduced pressure followed by cooling, filtration, washing with water, and drying to obtain a resin composition particle 1 that had a volume-based 50% particle diameter (D50) of 1.8 μm and 0.1 volume %≥10.0 μm.

The obtained resin composition particle 1 had an apparent density of 0.3 g/cm$^3$, a weight-average molecular weight Mw of 1,810,000, and a glass-transition temperature (Tg) for the resin component present in the resin composition of 99° C. The properties are given in Table 1.

<Resin Composition Particle Production Examples 2 and 3>

Resin composition particles 2 and 3 were prepared by changing the composition in Resin Composition Particle Production Example 1 as shown in Table 1. The properties are shown in Table 1.

TABLE 1

| | composition | molecular weight (Mw) | glass-transition temperature (° C.) |
|---|---|---|---|
| resin composition particle 1 | MMA:CHMA = 80:20 | 1,810,000 | 99 |
| resin composition particle 2 | MMA:CHMA = 50:50 | 1,150,000 | 94 |
| resin composition particle 3 | MMA = 100 | 1,930,000 | 104 |

<Toner Production Example>

A toner was produced using the materials and production method given below.

polyester resin: 100.0 mass parts (peak molecular weight Mp: 65,000, Tg: 65° C.)

C.I. Pigment Blue 15:3: 5.0 mass parts paraffin wax (melting point=75° C.): 5.0 mass parts aluminum 3,5-di-t-butylsalicylate compound: 0.5 mass parts These materials were mixed with a Henschel mixer and then melt-kneaded in a twin-screw extruder. The obtained kneaded material was cooled and coarsely pulverized to 1 mm or less using a coarse grinder to obtain a coarsely pulverized material. The resulting coarsely pulverized material was finely pulverized using a pulverizer followed by classification using a pneumatic classifier to obtain toner particles.

The obtained toner particles had a volume-based 50% particle diameter (D50) of 6.4 μm. The following substances were added per 100.0 mass parts of the obtained toner particles and external addition was performed using a Henschel mixer to produce a toner. This toner had a volume-based 50% particle diameter (D50) of 6.5 μm.

finely divided anatase titanium oxide powder: 1.0 mass parts (BET specific surface area=80 m$^2$/g, treated with 12 mass % isobutyltrimethoxysilane)

oil-treated silica: 1.5 mass parts (BET specific surface area=95 m$^2$/g, treated with 15 mass % silicone oil)

spherical silica: 1.5 mass parts (hexamethyldisilazane treated, BET specific surface area=24 m$^2$/g, number-average particle diameter=0.1 μm)

Example 1

A magnetic carrier was produced by carrying out a coating process using the apparatus shown in FIG. 1 and using the materials and production method described in the following.

In this example, the coating process was performed using an apparatus as shown in FIG. 1 in which the inner diameter of the main casing 1 was 130 mm and the rated power for the drive member 8 was 5.5 kW.

The spatial volume B of the minimum gap 18 between the inner circumferential surface of the main casing 1 and the stirring members 3 was $2.7\times10^{-4}$ $m^3$ and the maximum width D of the stirring members 3 was 25.0 mm. The volume A of the magnetic carrier core and resin composition particles, i.e., the processed material, was $5.7\times10^{-4}$ $m^3$ and A/B, i.e., the relationship with the spatial volume B of the minimum gap between the inner circumferential surface of the main casing 1 and the stirring members, was 2.1.

The distance C, which indicates the overlap region between the stirring member 3*a* and the stirring member 3*b*, was brought to 4.3 mm by adjusting the maximum width D of the stirring members 3 disposed on the rotating member 2, and C/D, i.e., the relationship with the maximum width D of the stirring members 3, was 0.17.

Using this apparatus structure, a coating process was carried out by adding 3.0 mass parts of the resin composition particle 1 per 100.0 mass parts of the magnetic carrier core.

In the first coating process step in the coating process in this example, the first coating process time KT was 300 seconds, the peripheral velocity of the outermost end of the stirring member 3 during KT was adjusted to 5 m/sec, and adjustment was carried out to provide a product temperature KF at the end of the first coating process of 48° C.

In the second coating process step that followed the completion of the first coating process step, the film-forming coating process time HT was 600 seconds, the peripheral velocity of the outermost end of the stirring member 3 in the second coating process step was adjusted to 11 m/sec, and adjustment was carried out to provide a product temperature HF at the end of the film-forming coating process of 100° C.

After the second coating process step, the peripheral velocity of the outermost end of the stirring member 3 was adjusted to 5 m/sec and rotation was carried out for 60 seconds and the processed material was cooled to 60° C. or below.

A bag for recovery of the magnetic carrier was then placed below the magnetic carrier discharge port 6; the magnetic carrier discharge port inner piece 17 was removed; and the rotating member 2 was rotated and the magnetic carrier was discharged through the magnetic carrier discharge port 6.

The obtained magnetic carrier was subjected to magnetic selection and the residual resin composition particles were separated using a circular vibrating screen provided with a screen with a diameter of 500 mm and an aperture of 75 μm, to yield a magnetic carrier 1. The coating process conditions are shown in Table 2. The obtained magnetic carrier was evaluated according to the criteria given below. The results of the evaluations are given in Table 3.

TABLE 2

| | examples | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| first coating process step | yes | yes | yes | yes | yes | yes | yes | yes | yes | yes | yes | yes | yes |
| second coating process step | yes | yes | yes | yes | yes | yes | yes | yes | yes | yes | yes | yes | yes |
| coating process apparatus | FIG. 1 | FIG. 1 | FIG. 1 | FIG. 1 | FIG. 1 | FIG. 1 | FIG. 1 | FIG. 1 | FIG. 1 | FIG. 1 | FIG. 1 | FIG. 1 | FIG. 1 |
| resin composition particle | 1 | 1 | 1 | 1 | 1 | 1 | 1 | 1 | 1 | 1 | 1 | 2 | 3 |
| amount of resin composition particle coated (mass parts) | 3.0 | 3.0 | 3.0 | 3.0 | 3.0 | 3.0 | 3.0 | 3.0 | 3.0 | 3.0 | 3.0 | 3.0 | 3.0 |
| A/B | 2.1 | 2.1 | 2.1 | 2.1 | 2.1 | 2.1 | 2.1 | 2.1 | 2.1 | 2.1 | 2.1 | 2.1 | 2.1 |
| C/D | 0.17 | 0.17 | 0.17 | 0.17 | 0.17 | 0.17 | 0.17 | 0.17 | 0.17 | 0.17 | 0.17 | 0.17 | 0.17 |
| peripheral velocity of the outermost end of the stirring member in the first coating process step (m/sec) | 5 | 5 | 5 | 5 | 5 | 5 | 5 | 5 | 5 | 7 | 3 | 5 | 5 |
| process time KT in the first coating process step (sec) | 300 | 600 | 900 | 60 | 60 | 60 | 60 | 1200 | 1800 | 1800 | 1800 | 300 | 300 |
| product temperature KF at the finish of the first coating process step (° C.) | 48 | 49 | 50 | 43 | 42 | 42 | 42 | 51 | 52 | 57 | 38 | 47 | 49 |
| peripheral velocity of the outermost end of the stirring member in the second coating process step (m/sec) | 11 | 11 | 11 | 11 | 18 | 8 | 8 | 8 | 8 | 8 | 8 | 8 | 9 |
| process time HT in the second coating process step (sec) | 600 | 600 | 600 | 600 | 600 | 600 | 600 | 600 | 600 | 600 | 600 | 600 | 600 |
| product temperature HF at the finish of the second coating process step (° C.) | 100 | 100 | 100 | 100 | 118 | 80 | 80 | 80 | 80 | 80 | 80 | 79 | 88 |

TABLE 2-continued

| | comparative examples | | | | | | | | | |
|---|---|---|---|---|---|---|---|---|---|---|
| | 1 | 2 | 3 | 4 | 5 | 6 | 7 | 8 | 9 | 10 |
| first coating process step | no | yes | yes | yes | yes | yes | yes | no | no | no |
| second coating process step | yes | yes | yes | yes | yes | yes | yes | yes | yes | yes |
| coating process apparatus | FIG. 1 | FIG. 1 | FIG. 1 | FIG. 1 | FIG. 1 | FIG. 1 | FIG. 1 | *C | *D | *E |
| resin composition particle | 1 | 1 | 1 | 1 | 1 | 1 | 1 | 1 | 1 | 1 |
| amount of resin composition particle coated (mass parts) | 3.0 | 3.0 | 3.0 | 3.0 | 3.0 | 3.0 | 3.0 | 3.0 | 3.0 | 3.0 |
| A/B | 2.1 | 2.1 | 2.1 | 2.1 | 2.1 | 2.1 | 2.1 | — | — | — |
| C/D | 0.17 | 0.17 | 0.17 | 0.17 | 0.17 | 0.17 | 0.17 | — | — | — |
| peripheral velocity of the outermost end of the stirring member in the first coating process step (m/sec) | — | 2 | 8 | 5 | 5 | 5 | 5 | — | — | — |
| process time KT in the first coating process step (sec) | — | 300 | 300 | 55 | 1860 | 300 | 300 | — | — | — |
| product temperature KF at the finish of the first coating process step (° C.) | — | 28 | 78 | 37 | 53 | 42 | 43 | — | — | — |
| peripheral velocity of the outermost end of the stirring member in the second coating process step (m/sec) | 11 | 11 | 11 | 11 | 11 | 7 | 21 | 40 | 40 | 80 |
| process time HT in the second coating process step (sec) | 600 | 600 | 600 | 600 | 600 | 600 | 600 *A | 1800 | 1800 | 1800 |
| product temperature HF at the finish of the second coating process step (° C.) | 100 | 100 | 100 | 100 | 99 | 53 | 137 *B | 90 | 90 | 100 |

*A stopped during coating at 300 sec
*B temperature at 300 sec
*C SP Granulator (Dalton Co., Ltd.)
*D Spartan Ryuzer (Dalton Co., Ltd.)
*E Mechano Hybrid (Nippon Coke & Engineering Co., Ltd.)

[Area % of the Region Originating with Metal Oxide on the Magnetic Carrier Surface]

The area % of the region originating with metal oxide on the magnetic carrier surface was determined by the method described above and the surface state of the magnetic carrier was evaluated based on the criteria given below. An evaluation of C or better is a practical level in the present invention.

A: very good

The area originating with metal oxide on the magnetic carrier surface is less than 2%.

B: good

The area originating with metal oxide on the magnetic carrier surface is at least 2% but less than 4%.

C: unproblematic from a practical standpoint

The area originating with metal oxide on the magnetic carrier surface is at least 4% but less than 7%.

D: somewhat poor

The area originating with metal oxide on the magnetic carrier surface is at least 7% but less than 10%.

E: poor

The area originating with metal oxide on the magnetic carrier surface is at least 10%.

A two-component developer was prepared by adding 10.0 mass parts of the above-described toner to 90.0 mass parts of the obtained magnetic carrier and mixing in a V-mixer. The evaluations indicated below were carried out under the conditions given below using the obtained two-component developer in an IRC3220N full-color copier from Canon Inc.

[Change in the Image Density]

For this evaluation, an initial evaluation was first carried out in which an image was output in a 30° C./80% RH environment with the developing bias adjusted so as to provide a developed toner mass on the photosensitive member of 0.6 g/cm$^2$. Then, 20,000 (20 k) prints of an image with a print percentage of 1% were output as in the initial evaluation while performing quantitative replenishment to provide a constant toner concentration, and the image density was measured after the 20 k durability test.

For the image density, a solid image was output and the density was measured using an X-Rite 500 densitometer and the image density was obtained as the average value for 6 points. When D1 represents the initial image density and D10 represents the image density after the 20 k durability test, the image density change D10/D1 was calculated and was scored according to the following criteria. An evaluation of C or better is a practical level in the present invention.

A: very good

The image density change D10/D1 is at least 95%.

B: good

The image density change D10/D1 is at least 85% but less than 95%.

C: unproblematic from a practical standpoint

The image density change D10/D1 is at least 75% but less than 85%.

D: somewhat poor

The image density change D10/D1 is at least 65% but less than 75%.

E: poor

The image density change D10/D1 is less than 65%.

[Retention of Q/M (mC/kg) on the Photosensitive Member]

For the evaluation, an initial evaluation was first performed in which, at the point at which the toner laid on level on the photosensitive member in a 30° C./80% RH environment reached 0.6 g/cm$^2$, the toner on the photosensitive member was collected by suctioning through a metal cylindrical tube and a cylindrical filter.

At this time, the amount of charge Q traversing the metal cylindrical tube and accumulated in a capacitor and the amount of collected toner M were measured and the amount of charge per unit mass Q/M (mC/kg) was calculated from this to provide the Q/M (mC/kg) on the photosensitive member.

Taking this initial Q/M on the photosensitive member to be 100%, a 20,000 print (20 k) durability test was then run in a 30° C./80% RH environment using an image with a print percentage of 40% and the retention rate for the Q/M on the photosensitive member after the 20 k durability test was determined and an evaluation was performed using the criteria given below.

retention rate(%)=[*Q/M* on the photosensitive member after the 20 k durability test]/[initial *Q/M* on the photosensitive member]×100

An evaluation of C or better is a practical level in the present invention.

A: very good

The retention rate of the Q/M on the photosensitive member is at least 90%.

B: good

The retention rate of the Q/M on the photosensitive member is at least 80% but less than 90%.

C: unproblematic from a practical standpoint

The retention rate of the Q/M on the photosensitive member is at least 70% but less than 80%.

D: somewhat poor

The retention rate of the Q/M on the photosensitive member is at least 60% but less than 70%.

E: poor

The retention rate of the Q/M on the photosensitive member is less than 60%.

[Leakage]

For the evaluation, the toner layer on the photosensitive member and the output solid image were visually evaluated at the point at which the toner laid on level on the photosensitive member in a 30° C./80% RH environment reached 0.6 g/cm$^2$ and were scored according to the criteria given below.

Leakage refers to a phenomenon in which, when the uniformity of the resin coat layer on the magnetic carrier surface is reduced, charge transfers to the surface of the photosensitive member from the developer carrying member via the magnetic carrier.

When this leakage event occurs, the potential of the latent image converges to the development potential and development does not occur. As a result, leakage tracks in the toner layer on the photosensitive member (locations where the toner layer is missing and the photosensitive member can be seen) are produced and, when leakage is severe, leakage tracks are also produced in a solid image (blank white areas). An evaluation of C or better is a practical level in the present invention.

A: very good

Leakage tracks are not seen in the toner layer on the photosensitive member.

B: good

Some leakage tracks are seen in the toner layer on the photosensitive member.

C: unproblematic from a practical standpoint

Leakage tracks are present on the photosensitive member, but are not seen in the solid image.

D: somewhat poor

Some leakage tracks are also seen in the solid image.

E: poor

Numerous leakage tracks are seen in an area of the solid image.

[Retention of Q/M (mC/Kg) after Standing]

For this evaluation, a 10,000 print (10 k) durability test was run using an image with a 30% print percentage in a 23° C./50% RH environment and the developing performance was evaluated.

After this, the developing device was removed from the machine and was held for 120 hours in a 40° C./90% RH environment, and the developing device was then re-installed in the machine and the amount of charge per unit mass [Q/M] (mC/kg) on the photosensitive member was measured.

Taking [Q/M] on the photosensitive member in the image evaluation after the 10,000 print (10 k) durability test to be 100%, the retention rate for the [Q/M] on the photosensitive member after the 120 hours of standing was calculated and was evaluated using the following criteria.

An evaluation of C or better is a practical level in the present invention.

A: very good

The retention rate of the Q/M on the photosensitive member is at least 90%.

B: good

The retention rate of the Q/M on the photosensitive member is at least 80% but less than 90%.

C: unproblematic from a practical standpoint

The retention rate of the Q/M on the photosensitive member is at least 70% but less than 80%.

D: somewhat poor

The retention rate of the Q/M on the photosensitive member is at least 60% but less than 70%.

E: poor

The retention rate of the Q/M on the photosensitive member is less than 60%.

TABLE 3

| | | examples | | | | | | | | | | | | |
|---|---|---|---|---|---|---|---|---|---|---|---|---|---|---|
| | | 1 | 2 | 3 | 4 | 5 | 6 | 7 | 8 | 9 | 10 | 11 | 12 | 13 |
| average circularity of the magnetic carrier | | 0.975 | 0.975 | 0.975 | 0.975 | 0.971 | 0.975 | 0.975 | 0.975 | 0.975 | 0.975 | 0.975 | 0.973 | 0.973 |
| magnetic carrier with a circularity less than or equal to 0.900 (number %) | | 0.5 | 0.5 | 0.5 | 0.5 | 1.0 | 0.6 | 0.6 | 0.7 | 0.4 | 0.6 | 0.6 | 0.1 | 0.1 |
| residual resin composition particles (volume %) | | 0.6 | 0.5 | 0.4 | 0.5 | 0.9 | 0.5 | 0.5 | 0.6 | 0.4 | 0.5 | 0.5 | 0.1 | 0.1 |
| evaluation 1 | surface state of the magnetic carrier | A (1%) | A (1%) | B (2%) | C (4%) | C (6%) | C (6%) | C (6%) | C (4%) | C (6%) | C (6%) | C (4%) | C (4%) | C (4%) |
| evaluation 2 | change in image density | A (98%) | A (95%) | B (93%) | B (88%) | C (84%) | C (84%) | C (84%) | B (85%) | C (80%) | C (77%) | C (78%) | B (90%) | B (85%) |
| evaluation 3 | retention of Q/M (mC/kg) on the photosensitive member | A (95%) | A (93%) | A (90%) | B (89%) | B (80%) | B (82%) | B (82%) | B (81%) | B (80%) | B (80%) | C (79%) | B (83%) | B (80%) |
| evaluation 4 | leakage | A | A | A | B | B | B | C | C | C | C | C | B | B |
| evaluation 5 | retention of Q/M (mC/kg) after standing | A (96%) | A (93%) | B (89%) | B (86%) | B (80%) | C (76%) | C (76%) | C (76%) | C (75%) | C (75%) | C (71%) | C (78%) | C (76%) |

| | | comparative examples | | | | | | | | | |
|---|---|---|---|---|---|---|---|---|---|---|---|
| | | 1 | 2 | 3 | 4 | 5 | 6 | 7 | 8 | 9 | 10 |
| average circularity of the magnetic carrier | | 0.972 | 0.973 | 0.970 | 0.972 | 0.972 | 0.969 | 0.965 | 0.968 | 0.966 | 0.951 |
| magnetic carrier with a circularity less than or equal to 0.900 (number %) | | 1.1 | 1.0 | 1.3 | 1.1 | 0.8 | 1.4 | 3.8 | 1.5 | 2.3 | 10.8 |
| residual resin composition particles (volume %) | | 1.0 | 0.9 | 1.1 | 1.2 | 0.9 | 2.1 | 6.1 | 2.8 | 3.5 | 14.1 |
| evaluation 1 | surface state of the magnetic carrier | C (6%) | C (6%) | D (7%) | B (3%) | B (3%) | C (6%) | D (9%) | D (9%) | E (11%) | E (12%) |
| evaluation 2 | change in image density | C (77%) | C (80%) | C (77%) | B (85%) | B (86%) | C (76%) | D (72%) | D (70%) | E (64%) | E (62%) |
| evaluation 3 | retention of Q/M (mC/kg) on the photosensitive member | C (76%) | C (78%) | D (68%) | B (80%) | C (79%) | C (70%) | C (70%) | D (65%) | E (59%) | E (57%) |
| evaluation 4 | leakage | D | D | D | D | C | D | D | D | E | E |
| evaluation 5 | retention of Q/M (mC/kg) after standing | C (74%) | C (77%) | C (71%) | C (73%) | D (69%) | C (70%) | D (63%) | D (62%) | E (55%) | E (50%) |

Examples 2 to 13

In Examples 2 to 13, magnetic carriers were prepared entirely the same as in Example 1, but changing the conditions for the coating process on the magnetic carrier 1 as shown in Table 2. The prepared magnetic carriers were then evaluated as in Example 1. The results are shown in Table 3.

Comparative Example 1

Using the apparatus shown in FIG. 1 as the coating processing apparatus, a magnetic carrier was prepared and evaluated as in Example 1, but omitting the first coating process step from the coating process and using only the second coating process step. The conditions in the coating process and the results of the evaluations are shown in Tables 2 and 3.

Specifically, the processed material was introduced into the coating processing apparatus shown in FIG. 1; the process time was set to 600 seconds; and the peripheral velocity of the outermost end of the stirring member 3 was adjusted to 11 m/sec so as to make the drive member 8 power constant at 3.5 kW.

Comparative Examples 2 to 7

Magnetic carriers were prepared in Comparative Examples 2 to 6 entirely the same as in Example 1, but changing the conditions for the coating process on the magnetic carrier 1 as shown in Table 2. The prepared magnetic carriers were then evaluated as in Example 1. The results are shown in Table 3. In Comparative Example 7, while the Example 1 conditions for the coating process on the magnetic carrier 1 were changed as in Table 2, the temperature within the apparatus rose and an overload occurred and the process was cut short at 300 seconds on the 600-second schedule; otherwise, the magnetic carrier was prepared as in Example 1. The prepared magnetic carrier was then evaluated as in Example 1.

Comparative Example 8

First, 3.0 mass parts of the resin composition particle 1 and 100.0 mass parts of the magnetic carrier core were introduced into a Henschel mixer (Nippon Coke & Engineering Co., Ltd.) and were mixed.

An SP Granulator (Dalton Co., Ltd.) was then used as the coating processing apparatus, and the obtained mixture was introduced and a coating process was run by stirring for 1800 seconds at a temperature of 90° C. using 40 m/sec for the peripheral velocity of the outermost end of the stirring blades.

After the end of the coating process, the peripheral velocity of the outermost end of the stirring blades was adjusted to 5 m/sec and operation was carried out for 600 seconds and the processed material was cooled to 60° C. or below; this was followed by removal to obtain the magnetic carrier.

The obtained magnetic carrier was subjected to magnetic selection and the residual resin composition particles were separated using a circular vibrating screen provided with a screen with a diameter of 500 mm and an aperture of 75 μm, to yield the magnetic carrier. The obtained magnetic carrier was evaluated as in Example 1. The conditions in the coating process and the results of the evaluations are given in Tables 2 and 3.

Comparative Example 9

First, 3.0 mass parts of the resin composition particle 1 and 100.0 mass parts of the magnetic carrier core were introduced into a Henschel mixer (Nippon Coke & Engineering Co., Ltd.) and were mixed.

A Spartan Ryuzer (Dalton Co., Ltd.) was then used as the coating processing apparatus, and the obtained mixture was introduced and a coating process was run by stirring for 1800 seconds at a temperature of 90° C. using 40 m/sec for the peripheral velocity of the outermost end of the stirring blades.

After the end of the coating process, the peripheral velocity of the outermost end of the stirring blades was adjusted to 5 m/sec and operation was carried out for 600 seconds and the processed material was cooled to 60° C. or below; this was followed by removal to obtain the magnetic carrier.

The obtained magnetic carrier was subjected to magnetic selection and the residual resin composition particles were separated using a circular vibrating screen provided with a screen with a diameter of 500 mm and an aperture of 75 μm, to yield the magnetic carrier. The obtained magnetic carrier was evaluated as in Example 1. The conditions in the coating process and the results of the evaluations are given in Tables 2 and 3.

Comparative Example 10

First, 3.0 mass parts of the resin composition particle 1 and 100.0 mass parts of the magnetic carrier core were introduced into a Henschel mixer (Nippon Coke & Engineering Co., Ltd.) and were mixed.

A Mechano Hybrid (Nippon Coke & Engineering Co., Ltd.) was then used as the coating processing apparatus, and the obtained mixture was introduced and a coating process was run by stirring for 1800 seconds at 100° C. using 80 m/sec for the peripheral velocity of the outermost end of the stirring blades.

After the end of the coating process, the peripheral velocity of the outermost end of the stirring blades was adjusted to 5 m/sec and operation was carried out for 600 seconds and the processed material was cooled to 60° C. or below; this was followed by removal to obtain the magnetic carrier.

The obtained magnetic carrier was subjected to magnetic selection and the residual resin composition particles were separated using a circular vibrating screen provided with a screen with a diameter of 500 mm and an aperture of 75 μm, to yield the magnetic carrier. The obtained magnetic carrier was evaluated as in Example 1. The conditions in the coating process and the results of the evaluations are given in Tables 2 and 3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-171423, filed on Aug. 1, 2012 which is hereby incorporated by reference herein in its entirety.

What is claimed is:

1. A method of producing a magnetic carrier, a surface of which is coated with a resin composition, comprising a coating process step in which a surface of a magnetic carrier core is coated with particles of the resin composition by a mechanical impact force, wherein:

the coating process step comprises;

a first coating process step of mixing, dispersing, and fixing the particles of the resin composition on the surface of the magnetic carrier core; and a second coating process step, which is performed after the first coating process step, of carrying out a film-forming coating process in which the particles of the resin composition fixed on the magnetic carrier core are spread on the surface of the magnetic carrier core, wherein:

the first coating process step and the second coating process step are carried out by using an apparatus provided with a rotating member having a plurality of stirring members on the surface thereof, a drive member that rotates the rotating member, and a main casing disposed so as to have a gap between an inner circumferential surface of the main casing and the stirring members, in the first coating process step and the second coating process step, the magnetic carrier core and the particles of the resin composition are transported by a part of the stirring members in a direction of the drive member that is one direction along an axial direction of the rotating member while being transported into the gap by a centrifugal force generated accompanying the rotation of the rotating member and are transported by another part of the stirring members in a counterdirection to the drive member that is an opposite direction to the one direction along the axial direction of the rotating member, and the coating of the surface of the magnetic carrier core with the particles of the resin composition is performed while repeating the transport in the direction of the drive member and the transport in the counterdirection to the drive member, wherein: when, KT (second) represents a coating process time in the first coating process step, KF (° C.) represents a product temperature at the finish of the coating process, and Tg represents a glass-transition temperature of the resin component present in the resin composition, the peripheral velocity of the outermost end of the stirring members during the coating process time in the first coating process step is at least 3 m/sec and not more than 7 m/sec, KT is at least 60 seconds and not more than 1800 seconds, KF satisfies KF≤Tg−40° C., and the peripheral velocity of the outermost end of the stirring members in the second coating process step is at least 8 m/sec and not more than 20 m/sec, and wherein: when, HF (° C.) represents a product temperature at the finish of the film-forming coating process in the second coating process step, and Tg represents a glass-transition temperature of the resin component present in the resin composition, HF satisfies Tg−20° C.≤HF≤Tg+20° C.

2. The method of producing a magnetic carrier according to claim 1, wherein KT is at least 60 seconds and not more than 900 seconds.

* * * * *